US007313519B2

(12) United States Patent
Crockett

(10) Patent No.: US 7,313,519 B2
(45) Date of Patent: Dec. 25, 2007

(54) TRANSIENT PERFORMANCE OF LOW BIT RATE AUDIO CODING SYSTEMS BY REDUCING PRE-NOISE

(75) Inventor: Brett Graham Crockett, Brisbane, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 774 days.

(21) Appl. No.: 10/476,347

(22) PCT Filed: Apr. 25, 2002

(86) PCT No.: PCT/US02/12957

§ 371 (c)(1),
(2), (4) Date: Oct. 28, 2003

(87) PCT Pub. No.: WO02/093560

PCT Pub. Date: Nov. 21, 2002

(65) Prior Publication Data

US 2004/0133423 A1 Jul. 8, 2004

Related U.S. Application Data

(60) Provisional application No. 60/290,286, filed on May 10, 2001.

(51) Int. Cl.
*G10L 21/02* (2006.01)

(52) U.S. Cl. ..... 704/226; 704/503; 704/504

(58) Field of Classification Search ..... 704/200, 704/211, 226, 500, 501, 503, 504
See application file for complete search history.

(56) References Cited

U.S. PATENT DOCUMENTS 4,464,784 A 8/1984 Agnello (Continued)

FOREIGN PATENT DOCUMENTS

EP 0372155 6/1990

(Continued)

OTHER PUBLICATIONS

Bregman, Albert S., "Auditory Scene Analysis—The Perceptual Organization of Sound," Massachusetts Institute of Technology, 1991, Fourth printer, 2001, Second MIT Press (Paperback ed.) 2nd, pp. 468-470.

(Continued)

*Primary Examiner*—Tālivaldis Ivars Šmits
*Assistant Examiner*—Douglas C Godbold
(74) *Attorney, Agent, or Firm*—Gallagher & Lathrop; Thomas A. Gallagher

(57) ABSTRACT

Distortion artifacts preceding a signal transient in an audio signal stream processed by a transform-based low-bit-rate audio coding system employing coding blocks are reduced by detecting a transient in the audio signal stream and shifting the temporal relationship of the transient with respect to the coding blocks such that the time duration of the distortion artifacts is reduced. The audio data is time scaled in such a way that the transients are temporally repositioned prior to quantization in a transform-based low-bit-rate audio encoder so as to reduce the amount of pre-noise in the decoded audio signal. Alternatively, or in addition, in a transform-based low-bit-rate audio coding system, a transient in the audio signal stream is detected and a portion of the distortion artifacts are time compressed such that the time duration of the distortion artifacts is reduced.

38 Claims, 8 Drawing Sheets

U.S. PATENT DOCUMENTS

| | | | | |
|---|---|---|---|---|
| 4,624,009 | A | 11/1986 | Glenn et al. | |
| 4,700,391 | A | 10/1987 | Leslie, Jr. et al. | |
| 4,703,355 | A | 10/1987 | Cooper | |
| 4,723,290 | A | 2/1988 | Watanabe et al. | |
| 4,792,975 | A | 12/1988 | MacKay | |
| 4,852,170 | A | 7/1989 | Bordeaux | |
| 4,864,620 | A | 9/1989 | Bialick | |
| 4,905,287 | A | 2/1990 | Segawa | |
| RE33,535 | E | 2/1991 | Cooper | |
| 5,023,912 | A | 6/1991 | Segawa | |
| 5,040,081 | A | 8/1991 | McCutchen | |
| 5,101,434 | A | 3/1992 | King | |
| 5,175,769 | A | 12/1992 | Hejna, Jr. | |
| 5,202,761 | A | 4/1993 | Cooper | |
| 5,216,744 | A | 6/1993 | Alleyne | |
| 5,268,685 | A * | 12/1993 | Fujiwara | 341/76 |
| 5,311,549 | A * | 5/1994 | Mahieux | 375/342 |
| 5,313,531 | A | 5/1994 | Jackson | |
| 5,450,522 | A | 9/1995 | Hermansky et al. | |
| 5,621,857 | A | 4/1997 | Cole et al. | |
| 5,634,082 | A * | 5/1997 | Shimoyoshi et al. | 704/200.1 |
| 5,717,768 | A * | 2/1998 | Laroche | 381/66 |
| 5,730,140 | A | 3/1998 | Fitch | |
| 5,749,073 | A | 5/1998 | Slaney | |
| 5,752,224 | A * | 5/1998 | Tsutsui et al. | 704/225 |
| 5,781,885 | A | 7/1998 | Inoue | |
| 5,828,994 | A * | 10/1998 | Covell et al. | 704/211 |
| 5,960,390 | A * | 9/1999 | Ueno et al. | 704/200.1 |
| 5,970,440 | A | 10/1999 | Veldhuis et al. | |
| 5,974,379 | A * | 10/1999 | Hatanaka et al. | 704/225 |
| 6,002,776 | A | 12/1999 | Bhadkamkar et al. | |
| 6,163,614 | A | 12/2000 | Chen | |
| 6,211,919 | B1 | 4/2001 | Zink et al. | |
| 6,246,439 | B1 | 6/2001 | Zink et al. | |
| 6,266,003 | B1 | 7/2001 | Hoek | |
| 6,266,644 | B1 * | 7/2001 | Levine | 704/503 |
| 6,360,202 | B1 | 3/2002 | Bhadkamkar et al. | |
| 6,487,536 | B1 * | 11/2002 | Koezuka et al. | 704/500 |
| 6,490,553 | B2 | 12/2002 | Van Thong et al. | |
| 6,801,898 | B1 * | 10/2004 | Koezuka | 704/500 |
| 7,020,615 | B2 * | 3/2006 | Vafin et al. | 704/500 |
| 2002/0116178 | A1 | 8/2002 | Crockett | |
| 2002/0120445 | A1 * | 8/2002 | Vafin et al. | 704/241 |
| 2004/0122772 | A1 | 6/2004 | Crockett | |
| 2004/0133423 | A1 | 7/2004 | Crockett | |
| 2004/0148159 | A1 | 7/2004 | Crockett | |
| 2004/0165730 | A1 | 8/2004 | Crockett | |
| 2004/0172240 | A1 | 9/2004 | Crockett | |

FOREIGN PATENT DOCUMENTS

| | | |
|---|---|---|
| EP | 0525544 | 2/1993 |
| EP | 0608833 | 8/1994 |
| EP | 0865026 | 9/1998 |
| JP | 1074097 | 3/1998 |
| WO | WO9119989 | 12/1991 |
| WO | WO 9627184 | 9/1996 |
| WO | WO 9701939 | 1/1997 |
| WO | WO 9820482 | 5/1998 |
| WO | WO 9933050 | 7/1999 |
| WO | WO 0013172 | 3/2000 |
| WO | WO 0019414 | 4/2000 |
| WO | WO0045378 | 8/2000 |
| WO | WO-02/084645 | 10/2002 |
| WO | WO-02/093560 | 11/2002 |
| WO | WO-02/097702 | 12/2002 |
| WO | WO-02/097790 | 12/2002 |
| WO | WO-02/097791 | 12/2002 |

OTHER PUBLICATIONS

Dattorro, J., "Effect Design Part 1: Reverberator and Other Filters," 1997, J. Audio Eng. Soc., 45(9):660-684.

Dembo, A., et al., "Signal Synthesis from Modified Discrete Short-Time Transform," 1988, IEEE Trans Acoust., Speech, Signal Processing, ASSP 36(2):168-181.

Fairbanks, G., et al., "Method for Time or Frequency Compression-Expansion of Speech," 1954, IEEE Trans Audio and Electroacoustics, AU-2:7-12.

Griffin D., et al., "Multiband Excitation Vocoder," 1988, IEEE. Trans. Acoust., Speech, Signal Processing, ASSP-36(2):236-243.

Laroche, J., "Autocorrelation Method for High Quality Time/Pitch Scaling," 1993, Procs. IEEE Workshop Appl. Of Signal Processing to Audio and Acoustics, Mohonk Mountain House, New Paltz, NY.

Laroche J., et al., "HNS: Speech Modification Based on a Harmonic + Noise Model," 1993a, Proc. IEEE ECASSP-93, Minneapolis, pp. 550-553.

Laroche, J., "Time and Pitch Scale Modification of Audio Signals," Chapter 7 of "Applications of Digital Processing to Audio and Acoustics," 1998, edited by Mark Kahrs and Karlheinz Brandenburg, Kluwer Academic Publishers.

Lee, F., "Time Compression and Expansion of Speech by the Sampling Method," 1972, J. Audio Eng. Soc., 20(9):738-742.

Lee, S., et al., "Variable Time-Scale Modification of Speech Using Transient Information," 1997, An IEEE Publication, pp. 1319-1322.

Lin, G.J., et al, "High Quality and Low Complexity Pitch Modification of Acoustic Signals," 1995, An IEEE Publication, pp. 2987-2990.

Makhoul, J., "Linear Predication: A tutorial Review," 1975, Proc. IEEE, 63(4):561-580.

Malah D., "Time-Domain Algorithms for Harmonic Bandwidth Reduction and Time Scaling of Speech Signals," 1979, IEEE Trans. On Acoustics, Speech, and Signal Processing ASSP-27(2):113-120.

Marques J., et al., "Frequency-Varying Sinusoidal Modeling of Speech," 1989, IEEE Trans. On Acoustics, Speech and Signal Processing, ASSP-37(5):763-765.

Moorer, J. A., "The Use of the Phase Vocoder in Computer Music Applications," 1978, J. Audio Eng. Soc., 26(1).

Press, William H., et al., "Numerical Recipes in C, The Art of Scientific Computing," 1988, Cambridge University Press, NY, pp. 432-434.

Portnoff, R., "Time-Scale Modifications of Speech Based on Short-Time Fourier Analysis," 1981, IEEE Trans. Acoust., Speech, Signal Processing 29(3):374-390.

Quatierei T., et al., "Speech Transformations Based on a Sinusoidal Representation," 1986, IEEE Trans on Acoustics, Speech and Signal Processing, ASSP-34(6):1449-1464.

Roehrig, C., "Time and Pitch Scaling of Audio Signals," 1990, Proc. 89th AES Convention, Los Angeles, Preprint 2954 (E-1).

Roucos, S., et al, "High Quality Time-Scale Modification of Speech," 1985, Proc. IEEE ICASSP-85, Tampa, pp. 493-496.

Shanmugan, K. Sam, "Digital and Analog Communication Systems," 1979, John Wiley & Sons, NY, pp. 278-280.

Schroeder, M., et al., "Band-Width Compression of Speech by Analytic-Signal Rooting," 1967, Proc. IEEE, 55:396-401.

Scott, R., et al., "Pitch-Synchronous Time Compression of Speech," 1972, Proceedings of the Conference for Speech Communication Processing, pp. 63-65.

Seneff, S., "System to Independently Modify Excitation and/or Spectrum of Speech Waveform without Explicit Pitch Extraction," 1982, IEEE Trans. Acoust., Speech, Signal Processing, ASSP-24:358-365.

Suzuki, R., et al., "Time-Scale Modification of Speech Signals Using Cross-Correlation Functions," 1992, IEEE Trans. on Consumer Electronics, 38(3):357-363.

Tan, Roland, K.C., "A Time-Scale Modification Algorithm Based on the Subband Time-Domain Technique for Broad-Band Signal Applications," May 2000, J. Audio Eng. Soc. vol. 48, No. 5, pp. 437-449.

Bristow-Johnson, Robert, "Detailed Analysis of a Time-Domain Formant-Corrected Pitch-Shifting Algorithm," May 1995, J. Audio Eng. Soc., vol. 43, No. 5, pp. 340-352.
George, E Bryan, et al., "Analysis-by-Synthesis/Overlap-Add Sinusoidal Modeling Applied to the Analysis and Synthesis of Musical Tones," Jun. 1992, J. Audio Eng. Soc., vol. 40, No. 6, pp. 497-515.
McAulay, Robert J., "Speech Analysis/Synthesis Based on a Sinusoidal Representation," Aug. 1986, IEEE Transactions on Acoustics, Speech and Signal Processing, vol. ASSP-34, No. 4, pp. 744-754.
Laroche, Jean, "Improved Phase Vocoder Time-Scale Modification of Audio," May 1999, IEEE Transactions on Speech and Audio Processing, vol. 7, No. 3, pp. 323-332.
Slyh, Raymond E., "Pitch and Time-Scale Modification of Speech: A Review of the Literature—Interim Report May 1994-May 1995," Armstrong Lab., Wright-Patterson AFB, OH, Crew Systems Directorate.
Audio Engineering Handbook, K. Blair Benson ed., McGraw Hill, San Francisco, CA 1988, pp. 1.40-1.42 and 4.8-4.10.
Tewfik, A.H., et al., "Enhanced Wavelet Based Audio Coder," Nov. 1, 1993, Signals, Systems and Computers, Conference Record of the 17th Asilomar Conference on Pacific Grove, CA, IEEE Comput. Soc pp. 896-900.
Vafin, R., et al., "Modifying Transients for Efficient Coding of Audio," May 2001, IEEE International Conference on Acoustics, Speech and Signal Processing, pp. 3285-3288, vol. 5.
Vafin, R., et al., Improved Modeling of Audio Signals by Modifying Transient Locations, Oct. 2001, Proceeding of the 2001 IEEE Workshop on the Applications of Signal Processing to Audio and Acoustics, pp. 143-146.
Karjalainen, M., et al., "Multi-Pitch and Periodcity Analysis Model for Sound Separation and Auditory Scene Analysis," Mar. 1999, Proc. ICASSP'99, pp. 929-932.
Levine, S .N., "Effects Processing on Audio Subband Data," 1996, Proc. Int. Computer Music Conf., HKUST, Hong Kong, pp. 328-331.
Levine, S. N., et al., "A Switched Parametric & Transform Audio Coder," Mar. 1999, Proc. ICASSP'99, pp. 985-988.
Mermelstein, P., et al., "Analysis by Synthesis Speech Coding with Generalized Pitch Prediction," Mar. 1999, Proc. ICASSP'99, pp. 1-4.
Pollard, M .P., et al., "Enhanced Shape—Invariant Pitch and Time-Scale Modification for Concatenative Speech Synthesis," Oct. 1996, Proc. Int. Conf. For Spoken Language Processing, ICLSP'96, vol. 3, pp. 1433-1436.
Verma, T. S., et al., An Analysis/Synthesis Tool for Transient Signals that Allows a Flexible Sines+Transients+Noise Model for Audio, May 1998, Proc. ICASSP'98, pp. 3573-3576.
Verma. T. S., et al., "Sinusoidal Modeling Using Frame-Based Perceptually Weighted Matching Pursuits," Mar. 1999 Proc. ICASSP'99, pp. 981-984.
Yim, S., et al., "Spectral Transformation for Musical Tones via Time Domain Filtering," Oct. 1997, Proc. 1997 IEEE Workshop on Applications of Signal Processing to Audio and Acoustics, pp. 141-144.
Edmonds, E. A., et al., "Automatic Feature Extraction from Spectrograms for Acoustic-Phonetic Analysis," 1992 vol. II, Conference B: Pattern Recognition Methodology and Systems, Proceedings, 11th IAPR International Conference on the Hague, Netherlands, USE, IEEE Computer Soc., Aug. 30, 1992, pp. 701-704.
Fishbach, Alon, "Primary Segmentation of Auditory Scenes," 12th IAPR International Conference on Pattern Recognition, Oct. 9-13, 1994, vol. III Conference C: Signal Processing, Conference D: Parallel Computing, IEEE Computer Soc., pp. 113-117.
Dolson, Mark, "The Phase Vocoder: A Tutorial," 1986, Computer Music Journal, 10(4):14-27.
Moulines, E., et al., "Pitch-Synchronous Waveform Processing Techniques for Text-to-Speech Synthesis Using Diphones," 1990, Speech Communication, 9(5/6):453-467.
Serra, X., et al., "Spectral Modeling Synthesis: A Sound Analysis/Synthesis System Based on a Deterministic Plus Stochastic Decomposition," 1990, In Proc. Of Int. Computer Music Conf., pp. 281-284, San Francisco, Ca.
Truax, Barry, "Discovering Inner Complexity: Time Shifting and Transposition with a Real-Time Granulation Technique," 1994, Computer Music J., 18(2):38-48.

* cited by examiner

FIG._1A
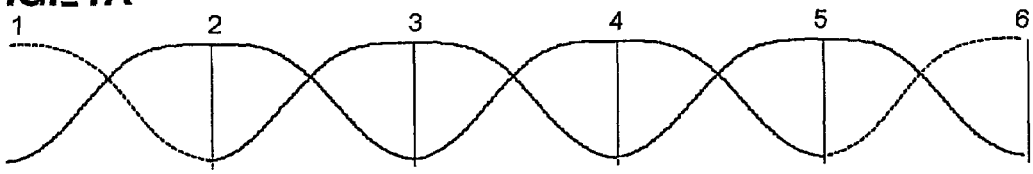
FIG._1B
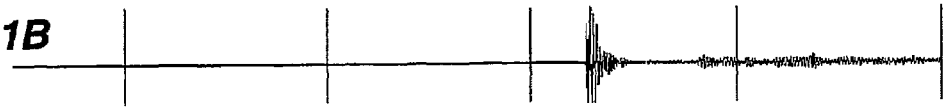
FIG._1C
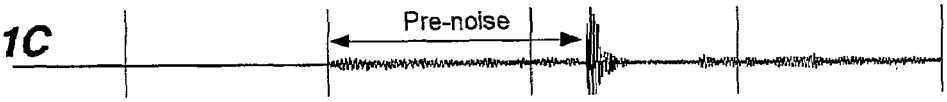
FIG._1D
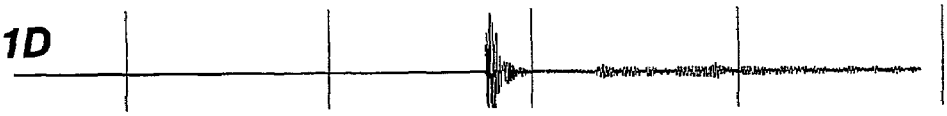
FIG._1E
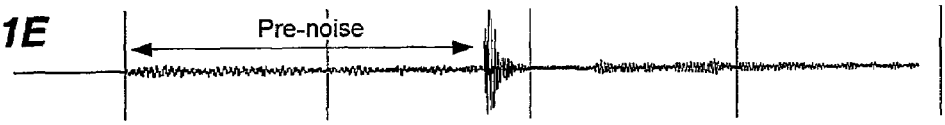
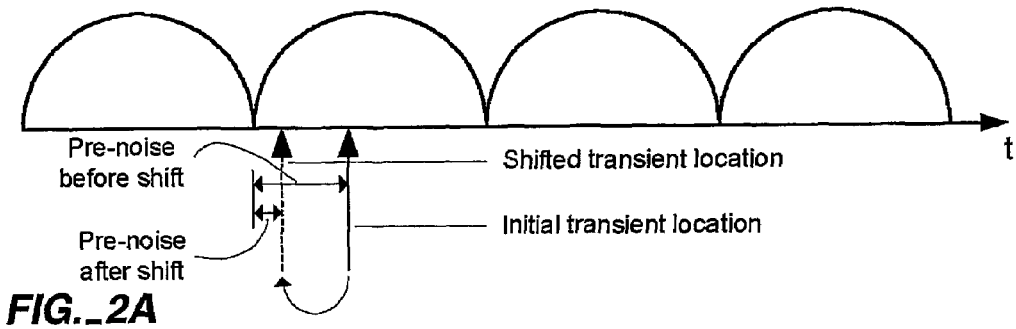
FIG._2A
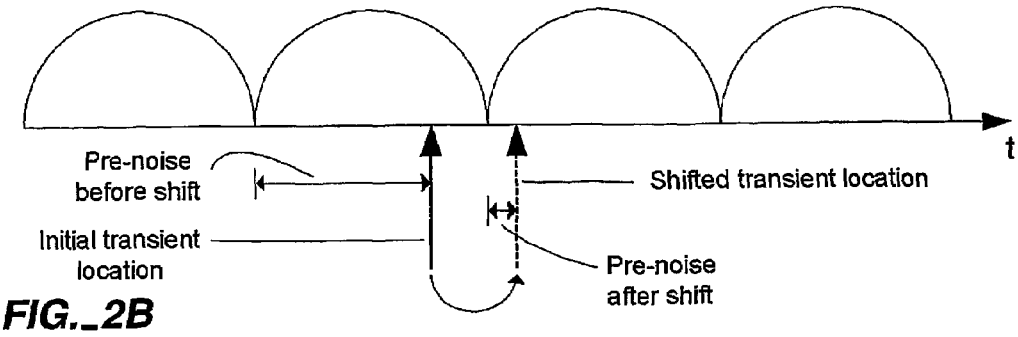
FIG._2B

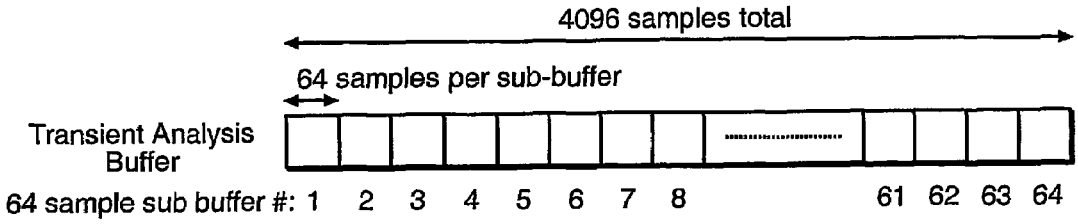
FIG._7
FIG._8A
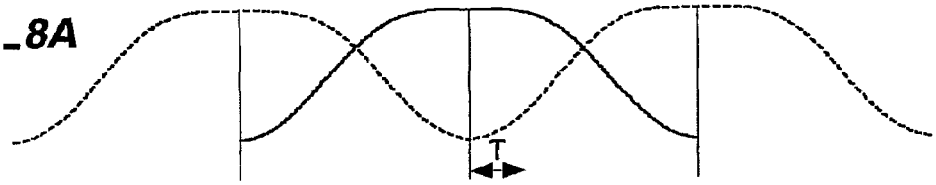
FIG._8B
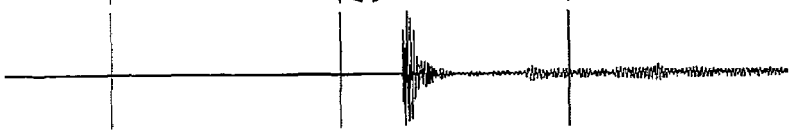
FIG._8C
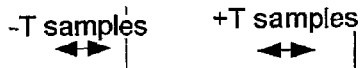
FIG._8D
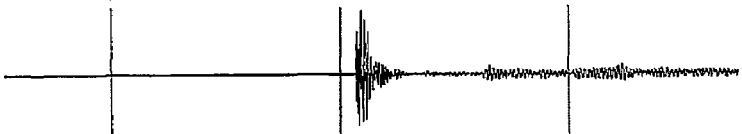
FIG._8E
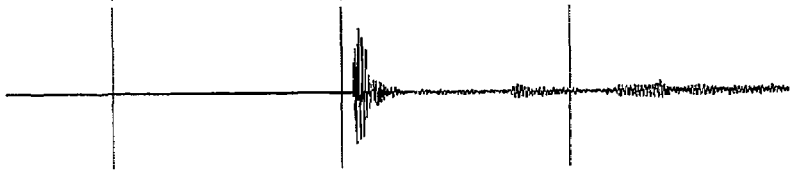

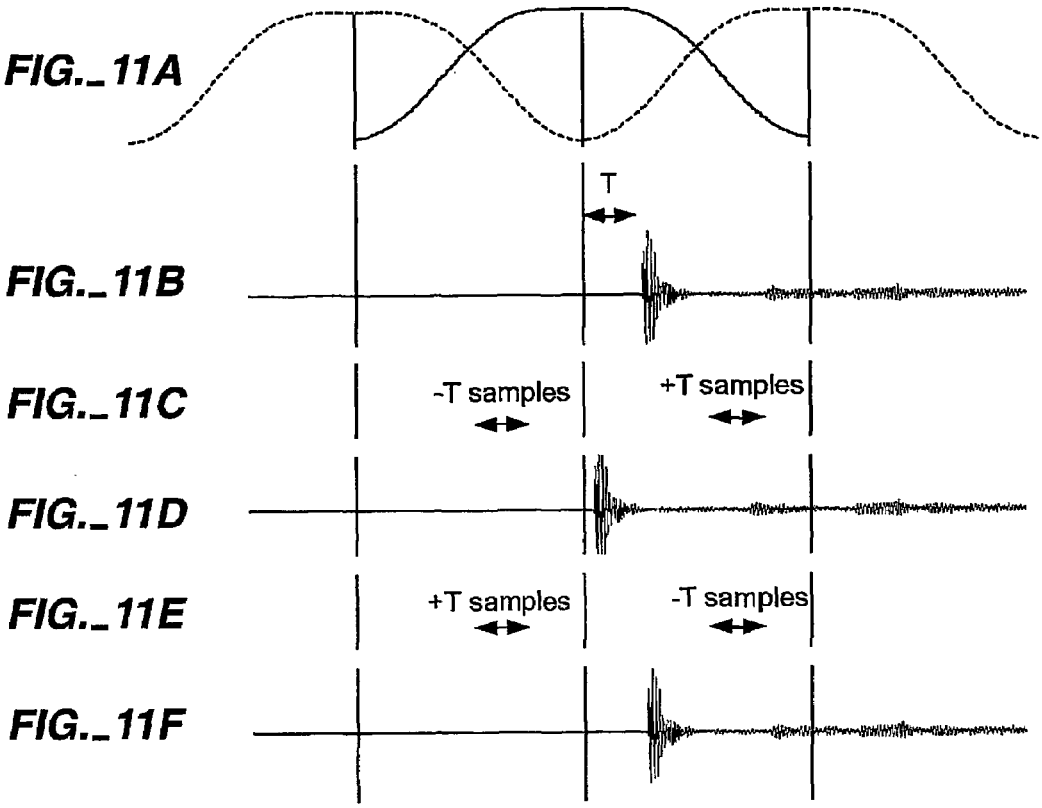
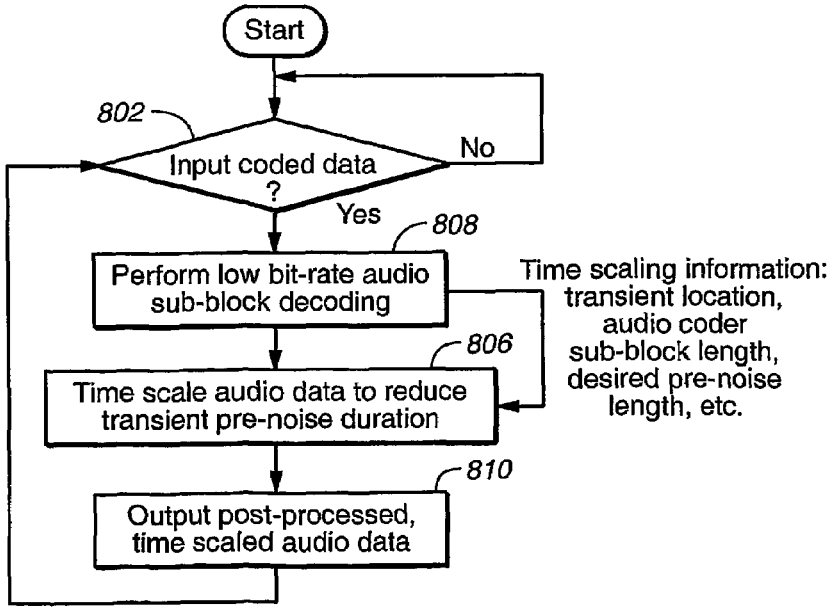
FIG._12

FIG._13A
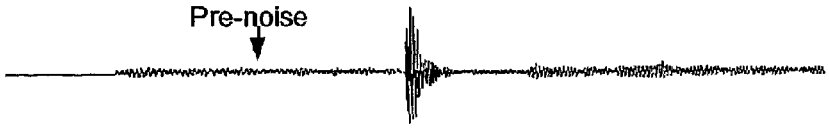
FIG._13B
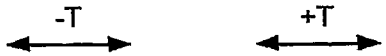
FIG._13C
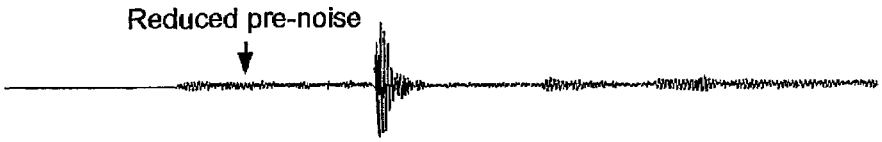
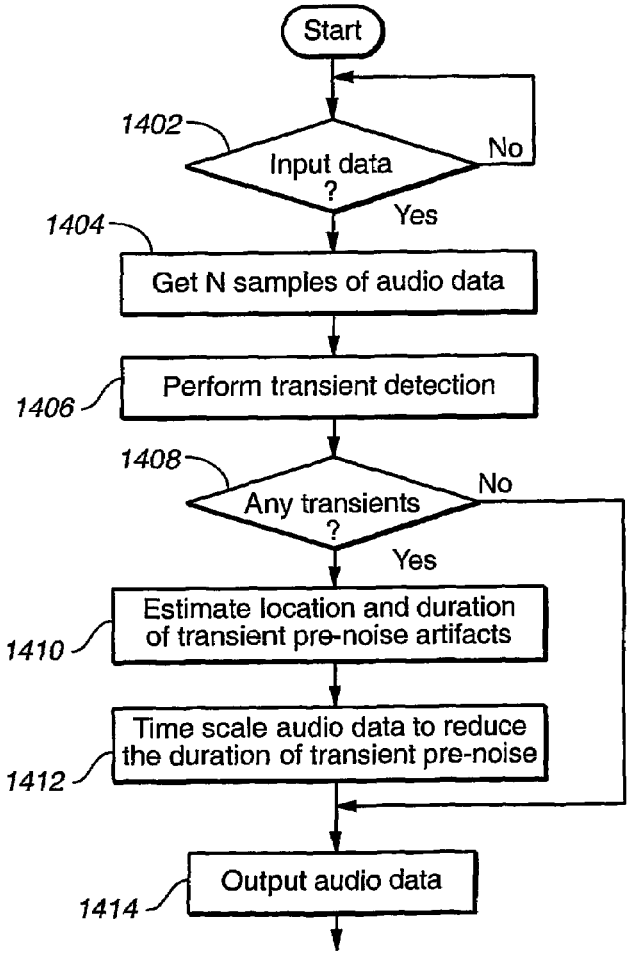
FIG._14

FIG._15A
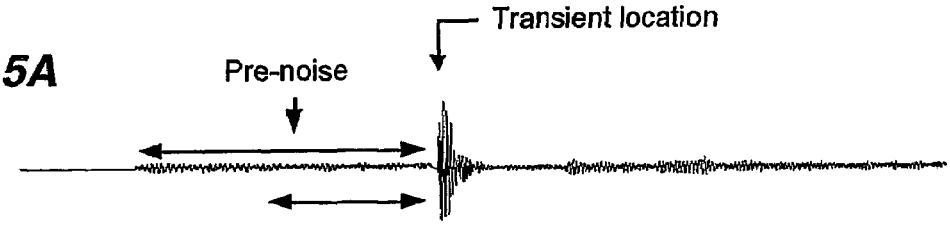
FIG._15B
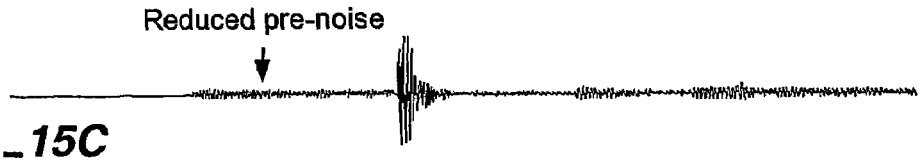
FIG._15C
FIG._16A
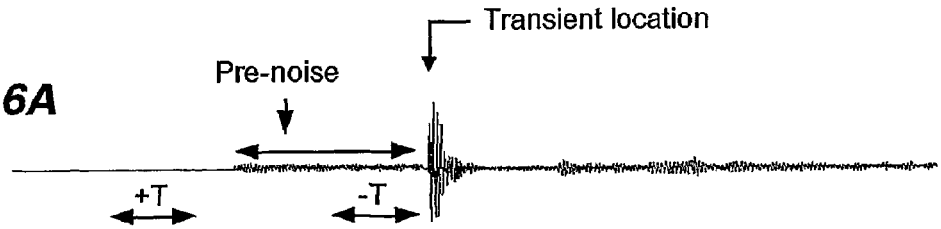
FIG._16B
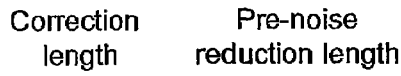
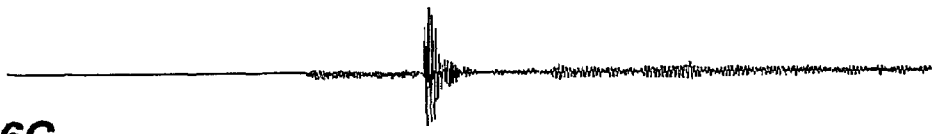
FIG._16C

TRANSIENT PERFORMANCE OF LOW BIT RATE AUDIO CODING SYSTEMS BY REDUCING PRE-NOISE

TECHNICAL FIELD

The invention relates generally to high-quality, low bit rate digital transform encoding and decoding of information representing audio signals such as music or voice signals. More particularly, the invention relates to the reduction of distortion artifacts preceding a signal transient ("pre-noise") in an audio signal stream produced by such an encoding and decoding system.

BACKGROUND ART

Time Scaling

Time scaling refers to altering the time evolution or duration of an audio signal while not altering its spectral content (perceived timbre) or perceived pitch (where pitch is a characteristic associated with periodic audio signals). Pitch scaling refers to modifying the spectral content or perceived pitch of an audio signal while not affecting its time evolution or duration. Time scaling and pitch scaling are dual methods of one another. For example, a digitized audio signal's pitch may be increased 5% without affecting its time duration by time scaling it by 5% (i.e., increasing the time duration of the signal) and then reading out the samples at a 5% higher sample rate (e.g., by resampling), thereby maintaining its original time duration. The resulting signal has the same time duration as the original signal but with modified pitch or spectral characteristics. Resampling is not an essential step of time scaling or pitch scaling unless it is desired to maintain a constant output sampling rate or to maintain the input and output sampling rates the same.

In aspects of the present invention, time scaling processing of audio streams is employed. However, as mentioned above, time scaling may also be performed using pitch-scaling techniques, as they are duals of one another. Thus, while the term "time scaling" is used herein, techniques that employ pitch scaling to achieve time scaling may also be employed.

Low Bit Rate Audio Coding

There is considerable interest among those in the field of signal processing to minimize the amount of information required to represent a signal without perceptible loss in signal quality. By reducing information requirements, signals impose lower information capacity requirements upon communication channels and storage media. With respect to digital coding techniques, minimal informational requirements are synonymous with minimal binary bit requirements.

Some prior art techniques for coding audio signals intended for human hearing attempt to reduce information requirements without producing any audible degradation by exploiting psychoacoustic effects. The human ear displays frequency-analysis properties resembling those of highly asymmetrical tuned filters having variable center frequencies. The ability of the human ear to detect distinct tones generally increases as the difference in frequency between the tones increases; however, the ear's resolving ability remains substantially constant for frequency differences less than the bandwidth of the above mentioned filters. Thus, the frequency-resolving ability of the human ear varies according to the bandwidth of these filters throughout the audio spectrum. The effective bandwidth of such an auditory filter is referred to as a critical band. A dominant signal within a critical band is more likely to mask the audibility of other signals anywhere within that critical band than other signals at frequencies outside that critical band. A dominant signal may mask other signals occurring not only at the same time as the masking signal, but also occurring before and after the masking signal. The duration of pre- and post-masking effects within a critical band depend upon the magnitude of the masking signal, but pre-masking effects are usually of much shorter duration than post-masking effects. See generally, the *Audio Engineering Handbook* K. Blair Benson ed., McGraw-Hill, San Francisco, 1988, pages 1.40-1.42 and 4.8-4.10.

Signal recording and transmitting techniques that divide the useful signal bandwidth into frequency bands with bandwidths approximating the ear's critical bands can better exploit psychoacoustic effects than wider band techniques. Techniques that exploit psychoacoustic masking effects can encode and reproduce a signal that is indistinguishable from the original input signal using a bit rate below that required by PCM coding.

Critical band techniques comprise dividing the signal bandwidth into frequency bands, processing the signal in each frequency band, and reconstructing a replica of the original signal from the processed signal in each frequency band. Two such techniques are sub-band coding and transform coding. Sub-band and transform coders can reduce transmitted informational requirements in particular frequency bands where the resulting coding inaccuracy (noise) is psychoacoustically masked by neighboring spectral components without degrading the subjective quality of the encoded signal.

A bank of digital bandpass filters may implement sub-band coding. Transform coding may be implemented by any of several time-domain to frequency-domain discrete transforms that implement a bank of digital bandpass filters. The remaining discussion relates more particularly to transform coders, therefore the term "sub-band" is used here to refer to selected portions of the total signal bandwidth, whether implemented by a sub-band coder or a transform coder. A sub-band as implemented by a transform coder is defined by a set of one or more adjacent transform coefficients; hence, the sub-band bandwidth is a multiple of the transform coefficient bandwidth. The bandwidth of a transform coefficient is proportional to the input signal sampling rate and inversely proportional to the number of coefficients generated by the transform to represent the input signal.

Psychoacoustic masking may be more easily accomplished by transform coders if the sub-band bandwidth throughout the audible spectrum is about half the critical bandwidth of the human ear in the same portions of the spectrum. This is because the critical bands of the human ear have variable center frequencies that adapt to auditory stimuli, whereas sub-band and transform coders typically have fixed sub-band center frequencies. To optimize the utilization of psychoacoustic-masking effects, any distortion artifacts resulting from the presence of a dominant signal should be limited to the sub-band containing the dominant signal. If the sub-band bandwidth is about half or less than half of the critical band and if filter selectivity is sufficiently high, effective masking of the undesired distortion products is likely to occur even for signals whose frequency is near the edge of the sub-band passband bandwidth. If the sub-band bandwidth is more than half a critical band, there is a possibility that the dominant signal may cause the ear's critical band to be offset from the coder's sub-band such that some of the undesired distortion products outside the ear's critical bandwidth are not masked. This effect is most objectionable at low frequencies where the ear's critical band is narrower.

The probability that a dominant signal may cause the ear's critical band to offset from a coder sub-band and thereby "uncover" other signals in the same coder sub-band is generally greater at low frequencies where the ear's critical band is narrower. In transform coders, the narrowest possible sub-band is one transform coefficient, therefore psychoacoustic masking may be more easily accomplished if the transform coefficient bandwidth does not exceed one half the bandwidth of the ear's narrowest critical band. Increasing the length of the transform may decrease the transform coefficient bandwidth. One disadvantage of increasing the length of the transform is an increase in the processing complexity to compute the transform and to encode larger numbers of narrower sub-bands. Other disadvantages are discussed below.

Of course, psychoacoustic masking may be achieved using wider sub-bands if the center frequency of these sub-bands can be shifted to follow dominant signal components in much the same way the ear's critical band center frequency shifts.

The ability of a transform coder to exploit psychoacoustic masking effects also depends upon the selectivity of the filter bank implemented by the transform. Filter "selectivity," as that term is used here, refers to two characteristics of sub-band bandpass filters. The first is the bandwidth of the regions between the filter pass-band and stopbands (the width of the transition bands). The second is the attenuation level in the stopbands. Thus, filter selectivity refers to the steepness of the filter response curve within the transition bands (steepness of transition band rolloff), and the level of attenuation in the stopbands (depth of stopband rejection).

Filter selectivity is directly affected by numerous factors including the three factors discussed below: block length, window weighting functions, and transforms. In a very general sense, block length affects coder temporal and frequency resolution, and windows and transforms affect coding gain.

Low Bit Rate Audio Coding/Block Length

The input signal to be encoded is sampled and segmented into "signal sample blocks" prior to sub-band filtering. The number of samples in the signal sample block is the signal sample block length.

It is common for the number of coefficients generated by a transform filter bank (the transform length) to be equal to the signal sample block length, but this is not necessary. An overlapping-block transform may be used and is sometimes described in the art as a transform of length N that transforms signal sample blocks with 2N samples. This transform can also be described as a transform of length 2N that generates only N unique coefficients. Because all the transforms discussed here can be thought to have lengths equal to the signal sample block length, the two lengths are generally used here as synonyms for one another.

The signal sample block length affects the temporal and frequency resolution of a transform coder. Transform coders using shorter block lengths have poorer frequency resolution because the discrete transform coefficient bandwidth is wider and filter selectivity is lower (decreased rate of transition band rolloff and a reduced level of stopband rejection). This degradation in filter performance causes the energy of a single spectral component to spread into neighboring transform coefficients. This undesirable spreading of spectral energy is the result of degraded filter performance called "sidelobe leakage."

Transform coders using longer block lengths have poorer temporal resolution because quantization errors cause a transform encoder/decoder system to "smear" the frequency components of a sampled signal across the full length of the signal sample block. Distortion artifacts in the signal recovered from the inverse transform are most audible as a result of large changes in signal amplitude that occur during a time interval much shorter than the signal sample block length. Such amplitude changes are referred to here as "transients." Such distortion manifests itself as noise in the form of an echo or ringing just before (pre-transient noise or "pre-noise") and just after (post-transient noise) the transient. Pre-noise is of particular concern because it is highly audible and, unlike post-transient noise, only minimally masked (a transient provides only minimal temporal pre-masking). Pre-noise is produced when the high frequency components of transient audio material are temporally smeared through the length of the audio coder block in which it occurs. The present invention is concerned with minimizing pre-noise. Post-transient noise typically is substantially masked and is not the subject of the present invention.

Fixed block length transform coders use a compromise block length that trades off temporal resolution against frequency resolution. A short block length degrades sub-band filter selectivity, which may result in a nominal pass-band filter bandwidth that exceeds the ear's critical bandwidth at lower or at all, frequencies. Even if the nominal sub-band bandwidth is narrower than the ear's critical bandwidth, degraded filter characteristics manifested as a broad transition band and/or poor stopband rejection may result in significant signal artifacts outside the ear's critical bandwidth. On the other hand, a long block length may improve filter selectivity but reduces temporal resolution, which may result in audible signal distortion occurring outside the ear's temporal psychoacoustic masking interval.

Window Weighting Function

Discrete transforms do not produce a perfectly accurate set of frequency coefficients because they work with only a finite-length segment of the signal, the signal sample block. Strictly speaking, discrete transforms produce a time-frequency representation of the input time-domain signal rather than a true frequency-domain representation which would require infinite signal sample block lengths. For convenience of discussion here, however, the output of discrete transforms is referred to as a frequency-domain representation. In effect, the discrete transform assumes that the sampled signal only has frequency components whose periods are a submultiple of the signal sample block length. This is equivalent to an assumption that the finite-length signal is periodic. The assumption in general, of course, is not true. The assumed periodicity creates discontinuities at the edges of the signal sample block that cause the transform to create phantom spectral components.

One technique that minimizes this effect is to reduce the discontinuity prior to the transformation by weighting the signal samples such that samples near the edges of the signal sample block are zero or close to zero. Samples at the center of the signal sample block are generally passed unchanged, i.e., weighted by a factor of one. This weighting function is called an "analysis window." The shape of the window directly affects filter selectivity.

As used here, the term "analysis window" refers only to the windowing function performed prior to application of the forward transform. The analysis window is a time-domain function. If no compensation for the window's effects is provided, the recovered or "synthesized" signal is distorted according to the shape of the analysis window. One compensation method known as overlap-add is well known in the art. This method requires the coder to transform overlapped blocks of input signal samples. By carefully designing the analysis window such that two adjacent windows add to unity across the overlap, the effects of the window are exactly compensated.

Window shape affects filter selectivity significantly. See generally, Harris, "On the Use of Windows for Harmonic Analysis with the Discrete Fourier Transform," *Proc IEEE,* vol. 66, January, 1978, pp. 51-83. As a general rule, "smoother" shaped windows and larger overlap intervals provide better selectivity. For example, a Kaiser-Bessel window generally provides for greater filter selectivity than a sine-tapered rectangular window.

When used with certain types of transforms such as the Discrete Fourier Transform (DFT), overlap-add increases the number of bits required to represent the signal because the portion of the signal in the overlap interval must be transformed and transmitted twice, once for each of the two overlapped signal sample blocks. Signal analysis/synthesis for systems using such a transform with overlap-add is not critically sampled. The term "critically sampled" refers to a signal analysis/synthesis which over a period of time generates the same number of frequency coefficients as the number of input signal samples it receives. Hence, for noncritically sampled systems, it is desirable to design the window with an overlap interval as small as possible in order to minimize the coded signal information requirements.

Some transforms also require that the synthesized output from the inverse transform be windowed. The synthesis window is used to shape each synthesized signal block. Therefore, the synthesized signal is weighted by both an analysis and a synthesis window. This two-step weighting is mathematically similar to weighting the original signal once by a window whose shape is equal to a sample-by-sample product of the analysis and synthesis windows. Therefore, in order to utilize overlap-add to compensate for windowing distortion, both windows must be designed such that the product of the two sums to unity across the overlap-add interval.

While there is no single criterion that may be used to assess a window's optimality, a window is generally considered "good" if the selectivity of the filter used with the window is considered "good." Therefore, a well designed analysis window (for transforms that use only an analysis window) or analysis/synthesis window pair (for transforms that use both an analysis and a synthesis window) can reduce sidelobe leakage.

Block Switching

A common solution that addresses the compromise between temporal and frequency resolution in fixed block length transform coders is the use of transient detection and block length switching. In this solution the presence and location of audio signal transients are detected using various transient detection methods. When transient audio signals are detected that are likely to introduce pre-noise when coded using a long audio coder block length, the low bit rate coder switches from the more efficient long block length to a less efficient shorter block length. While this reduces the frequency resolution and coding efficiency of the encoded audio signal it also reduces the length of transient pre-noise introduced by the coding process, improving the perceived quality of the audio upon low bit rate decoding. Techniques for block length switching are disclosed in U.S. Pat. Nos. 5,394,473; 5,848,391; and 6,226,608 B1, each of which is hereby incorporated by reference in its entirety. Although the present invention reduces pre-noise without the complexity and disadvantages of block switching, it may be employed along with and in addition to block switching.

DISCLOSURE OF THE INVENTION

In accordance with a first aspect of the present invention, a method for reducing distortion artifacts preceding a signal transient in an audio signal stream processed by a transform-based low-bit-rate audio coding system employing coding blocks comprises detecting a transient in the audio signal stream, and shifting the temporal relationship of the transient with respect to the coding blocks such that the time duration of the distortion artifacts is reduced.

An audio signal is analyzed and the locations of transient signals are identified. The audio data is then time scaled in such a way that the transients are temporally repositioned prior to quantization in a transform-based low-bit-rate audio encoder so as to reduce the amount of pre-noise in the decoded audio signal. Such processing prior to encoding and decoding is referred to herein as "pre-processing."

Thus, before quantization in the encoder, because the quantization process smears the transient throughout the encoding block creating the undesired pre-noise artifacts, the transient is shifted to a better position vis-à-vis block ends using time scaling (time compression or time expansion). Such pre-processing may also be referred to as "transient time shifting". Transient time shifting requires the identification of transients and also requires information as to their temporal location relative to block ends. In principle, transient time shifting may be accomplished in the time domain prior to application of the forward transform or in the frequency domain following application of the forward transform but prior to quantization. In practice, transient time shifting may be more easily accomplished in the time domain prior to application of the forward transform, particularly when a compensating time scaling is performed as described below.

The results of transient time shifting may be audible because both the transient and the audio stream are no longer in their original relative temporal positions—the time evolution of the audio stream is altered as a result of time compression or time expansion of the audio stream before the transient. A listener may perceive this as an alteration in the rhythm within a musical piece, for example.

There are several compensation techniques for reducing such an alteration in the audio stream's time evolution that form aspects of the present invention. These compensation techniques are optional because slight variations in the temporal evolution of an audio signal are not discernable to most listeners. Compensation techniques are discussed after the following discussion of a second aspect of the present invention.

In accordance with a second aspect of the present invention, in an encoder of a transform-based low-bit-rate audio coding system employing coding blocks, a method for reducing distortion artifacts preceding a signal transient in an audio signal stream subsequent to inverse transformation, comprises detecting a transient in the audio signal stream, and time compressing at least a portion of the distortion artifacts such that the time duration of the distortion artifacts is reduced.

By such processing, referred to as "post-processing" herein, audio quality improvements to any audio signal that has undergone low bit rate audio encoding may be obtained whether or not pre-processing is employed and, if it is employed, whether or not the encoder transmits metadata useful for the post-processing. Any audio signal that has undergone low bit rate audio encoding and decoding may be analyzed to identify the location of transient signals and to estimate the duration of transient pre-noise artifacts. Then, time scale post-processing may be performed on the audio so as to remove the transient signal pre-noise or reduce its duration.

As mentioned above, there are several compensation techniques for reducing alterations in the audio stream's time evolution. These time scaling compensation techniques also have the beneficial result of keeping the number of audio samples constant.

A first time scaling compensation technique, useful in connection with pre-processing, is applied before the forward transform. It applies a compensating time scaling to the audio stream following the transient, the time scaling having a sense opposite to the sense of the time scaling employed to shift the transient position and, preferably, having substantially the same duration as the transient-shifting time scaling. For convenience in discussion, this type of compensation is referred to herein as "sample number compensation" because it is capable of keeping the number of audio samples constant but is not capable of fully restoring the original temporal evolution of the audio signal stream (it leaves the transient and portions of the signal stream near the transient out of place temporally). Preferably, the time-scaling providing sample number compensation closely follows the transient such that it is temporally post-masked by the transient.

Although sample number compensation leaves the transient shifted from its original temporal position, it does restore the audio stream following the compensating time scaling to its original relative temporal position. Thus, the likelihood of audibility of the transient time shifting is reduced, although it is not eliminated, because the transient is still out of its original position. Nevertheless, this may provide a sufficient reduction in audibility and it has the advantage that it is done prior to low bit-rate audio encoding, allowing the use of a standard, unmodified decoder. As explained below, a full restoration of the audio signal stream's time evolution can only be accomplished by processing in the decoder or following the decoder. In addition to reducing the possibility of audibility of the transient time shifting, time-scaling compensation before forward transformation has the advantage of keeping the number of audio samples constant, which may be important for processing and/or for the operation of hardware implementing the processing.

In order to provide optimum time-scaling compensation before forward transformation, information as to the location of the transient and the temporal length of the transient time shifting should be employed by the compensation process.

If transient time shifting is applied after blocking (but before applying the forward transform), it is necessary to employ sample number compensation within the same block in which transient time shifting is done in order to keep the block length the same. Consequently, it is preferred to perform transient time shifting and sample number compensation before blocking.

Sample number compensation may also be employed after the inverse transform (either in the decoder or after decoding) in connection with post-processing. In this case, information useful for performing compensation may be sent to the compensation process from the decoder (which information may have originated in the encoder and/or the decoder).

A more complete restoration of the audio signal stream's temporal evolution along with restoring the original number of audio samples may be accomplished after the inverse transform (either in the decoder or following decoding), by apply a compensating time scaling to the audio stream before the transient in the sense opposite to the sense of the time scaling employed to shift the transient position and, preferably, of substantially the same duration as the transient-shifting time scaling. For convenience in discussion, this type of compensation is referred to herein as "time evolution compensation." This time scaling compensation has the significant advantage of restoring the entire audio stream, including the transient, to its original relative temporal position. Thus, the likelihood of audibility of the time scaling processes is greatly reduced, although not eliminated, because the two time scaling processes themselves may cause audible artifacts.

In order to provide optimum time-evolution compensation, various information such as the location of the transient, the location of the block ends, the length of the transient time shifting, and the length of the pre-noise is useful. The length of the pre-noise is useful in assuring that the time-scaling of the time evolution compensation does not occur during the pre-noise, thus possibly expanding the temporal length of the pre-noise. The length of the transient time shifting is useful if it is desired to restore the audio stream to its original relative temporal position and to maintain the number of samples constant. The location of the transient is useful because the length of the pre-noise may be determined from the original location of the transient with respect to the ends of the coding blocks. The length of the pre-noise may be estimated by measuring a signal parameter, such as high-frequency content or a default value may be employed. If the compensation is performed in the decoder or after decoding, useful information may be sent by the encoder as metadata along with the encoded audio. When performed after decoding, metadata may be sent to the compensation process from the decoder (which information may have originated in the encoder and/or the decoder).

As mentioned above, post-processing to reduce the length of the pre-noise artifact may also be applied as an additional step to an audio coder that performs time scaling pre-processing and, optionally, provides metadata information. Such post-processing would act as an additional quality improvement scheme by reducing the pre-noise that may still remain after pre-processing.

Pre-processing may be preferred in coder systems employing professional encoders in which cost, complexity and time-delay are relatively immaterial in comparison to post-processing in connection with a decoder, which is typically a lower complexity consumer device.

The low bit rate audio coding system quality improvement technique of the present invention may be implemented using any suitable time-scaling technique, as well as any that may become available in the future. One suitable technique is described in International Patent Application PCT/US02/04317, filed Feb. 12, 2002, entitled High Quality Time-Scaling and Pitch-Scaling of Audio Signals. Said application designates the United States and other entities. The application is hereby incorporated by reference in its entirety. As discussed above, since time scaling and pitch shifting are dual methods of one another, time scaling may also be implemented using any suitable pitch scaling technique, as well as any that may become available in the future. Pitch scaling following by reading out the audio samples at an appropriate rate that is different than the input sample rate results in a time scaled version of the audio with the same spectral content or pitch of the original audio and is applicable to the present invention.

As discussed in the low bit rate audio coding background summary, the selection of block length in an audio coding system is a trade-off between frequency and temporal resolution. In general, a longer block length is preferred as it provides increased efficiency of the coder (generally provides greater perceived audio quality with a reduced number of data bits) in comparison to a shorter block length. However, transient signals and the pre-noise signals that they generate offset the quality gain of longer block lengths by introducing audible impairments. It is for this reason that block switching or fixed smaller block lengths are used in practical applications of low bit rate audio coders. However, applying time scaling pre-processing in accordance with the present invention to audio data that is to undergo low bit rate audio coding and/or has undergone post-processing may reduce the duration of transient pre-noise. This allows longer audio coding block lengths to be used, thereby providing increased coding efficiency and improving perceived audio quality without adaptively switching block lengths. However, the reduction of pre-noise in accordance with the present invention may be also employed in coding systems that employ block length switching. In such systems, some pre-noise may exist even for the smallest window size. The larger the window, the longer and, consequently, more audible the pre-noise is. Typical transients provide approximately 5 msec of premasking, which translates to 240 samples at a 48 kHz sampling rate. If a window is larger than 256 samples, which is common in a block switching arrangement, the invention provides some benefit.

Audio Coding Transient Pre-Noise Artifacts

FIGS. 1*a*-1*e* show examples of transient pre-noise artifacts generated by a fixed block length audio coder system. FIG. 1*a* shows six, 50% overlapped, audio coding windowed blocks of fixed length 1 through 6. In this figure and all other figures herein, each window is contiguous with an audio coding block and is referred to as a "windowed block," "window," or "block." In this figure and certain other figures herein, the windows are shown generally in the shape of a Kaiser-Bessel window. Other figures show windows in the shape of semi-circles for simplicity in presentation. Window shape is not critical to the present invention. While the length of the windowed blocks in FIG. 1*a* and other figures is not critical to the invention, fixed length windowed blocks typically are in the range of 256 to 2048 samples in a length. The four audio signal examples in FIGS. 1*b* through 1*e* illustrate, respectively, the effects of temporal relationships between the audio coding windowed blocks and the transient pre-noise artifacts.

FIG. 1*b* illustrates the relationship between the location of a transient signal in an input audio stream to be coded and the borders of the 50% overlapping windowed blocks. While a 50% overlapping fixed block length is shown, the invention is applicable to both fixed and variable block length coding systems and to blocks having other than a 50% overlap, including no overlap as is discussed below in connection with FIGS. 2*a* through 5*b*.

FIG. 1*c* shows the audio signal stream output of the audio coding system for the case of an audio signal stream input as shown in FIG. 1*b*. As shown in FIGS. 1*b* and 1*c*, the transient is located between the end of windowed block 3 and the end of windowed block 4. FIG. 1*c* illustrates the location and length of transient pre-noise introduced by the low bit rate audio coding process in relation to the location of the transient and the end of windowed block 2. Note that the pre-noise is prior to the transient and is limited to windowed blocks 4 and 5, the sample blocks in which the transient lies. Thus, the pre-noise extends back to the beginning of windowed block 4.

Similarly to FIGS. 1*b* and 1*c*, FIGS. 1*d* and 1*e* show, respectively, the relationship between an input audio signal stream that contains a transient located between the end of windowed block 2 and the end of windowed block 3 and the pre-noise introduced in the output audio signal stream by the audio coding system. Because the pre-noise is limited to windowed blocks 3 and 4, within which the transient lies, the pre-noise extends back to the beginning of windowed block 3. In this case, the pre-noise has a longer duration because the transient is nearer the end of windowed block 3 than the transient of FIGS. 1*b* and 1*c* is to the end of windowed block 4. The ideal transient location is closely following the last block end so that the pre-noise extends back only to the next prior block end (about half of the block length in the case of this 50% block overlap example).

It should be noted that the examples in FIGS. 1*a*-1*e* do not explicitly take into account the effects of cross fading at the coding window boundaries. In general, as the audio coding windows taper off, the pre-noise artifacts are scaled accordingly and their audibility is reduced. For simplicity in presentation, scaling of the pre-noise artifacts is not shown in the idealized waveforms of the figures herein.

As suggested in FIGS. 1*a*-1*e* and shown in more detail in FIGS. 2A, 2B, 3A, 3B, 4A, 4B, 5A and 5B, an audio coder's transient pre-noise artifacts may be minimized if the location of transient signals is judiciously positioned prior to audio encoding.

Examples of repositioning the location of a transient in order to reduce pre-noise are shown in FIGS. 2*a*, 2*b*, 3*a*, 3*b*, 4*a*, 4*b*, 5*a* and 5*b* for the cases of non-overlapping blocks (FIGS. 2*a* and 2*b*), less than 50% block overlap (FIGS. 3*a* and 3*b*), 50% block overlap (FIGS. 4*a* and 4*b*), and greater than 50% block overlap (FIGS. 5*a* and 5*b*). In each case, unless the original position of the transient is equidistant between two successive block ends (in which case there is no preference), it is preferred to shift the transient to a position closely following the nearest block end. Whether the shift is to the prior block end or to the next block end, whether or not the nearest block end, the resulting pre-noise is substantially the same. However, by temporally shifting the transient to a location closely following the nearest block end, disruption to the time evolution of the audio stream is minimized, thereby minimizing the possible audibility of shifting the transient. Nevertheless, in some cases, shifting to the more distant block end may also be inaudible. Moreover, even if a shifting to the more distant block end is audible, time evolution compensation, as described below, may be employed to reduce or eliminate such audibility.

FIGS. 2*a* and 2*b* show a series of idealized non-overlapping windowed blocks. In FIG. 2*a*, a transient's initial location is, as shown by the solid-lined arrow, closer to the last window end than it is to the next window end. The pre-noise for the transient's initial location extends back in time to the end of the beginning of the window, as shown. If it is desired to minimize the degree of temporal shift of the transient, it should be shifted "left" (backward in time) to a location closely following the end of the last windowed block, as shown. Although the resulting pre-noise still extends back to the beginning of the windowed block, this length is very short compared to the pre-noise resulting from the initial transient location. In this and other figures, the distance of the shifted transient from the windowed block end is exaggerated for clarity in presentation. In FIG. 2*b,* the initial position of the transient is closer to the next window end than to the previous window end. Thus, if it is desired to minimize the degree of temporal shift of the transient, it should be shifted "right" (later in time) to a location closely following the end of the next windowed block, as shown. It will be noted that the improvement in pre-noise reduction increases as the initial transient position becomes later in the windowed block.

FIGS. 3*a* and 3*b* show a series of idealized windowed blocks that overlap by less than 50%. In FIG. 3*a,* a transient's initial location is, as shown by the solid-lined arrow, closer to the last window end than it is to the next window end. The pre-noise for the transient's initial location extends back in time to the end of the beginning of the window, as shown. If it is desired to minimize the degree of temporal shift of the transient, it should be shifted "left" to a location closely following the end of the last windowed block, as shown. The resulting pre-noise still extends back to the beginning of the windowed block, but this length is short compared to the pre-noise resulting from the initial transient location. In FIG. 3*b,* the initial position of the transient is closer to the next window end than to the previous window end. Thus, if it is desired to minimize the degree of temporal shift of the transient, it should be shifted "right" to a location closely following the end of the next windowed block, as shown. It will be noted that the improvement in pre-noise reduction increases as the initial transient position is later in the interval between successive windowed blocks.

FIGS. 4*a* and 4*b* show a series of idealized windowed blocks that overlap by 50%. In FIG. 4*a,* a transient's initial location is, as shown by the solid-lined arrow, closer to the last window end than it is to the next window end. The pre-noise for the transient's initial location extends back in time to the end of the beginning of the window, as shown. If it is desired to minimize the degree of temporal shift of the transient, it should be shifted "left" to a location closely following the end of the last windowed block, as shown. The resulting pre-noise still extends back to the beginning of the windowed block, but this length is shorter than the pre-noise resulting from the initial transient location. In FIG. 4*b,* the initial position of the transient is closer to the next window end than to the previous window end. Thus, if it is desired to minimize the degree of temporal shift of the transient, it should be shifted "right" to a location closely following the end of the next windowed block as shown. It will be noted that the improvement in pre-noise reduction increases as the initial transient position is later in the interval between successive windowed block ends, as in the case of less than 50% overlapped blocks.

FIGS. 5*a* and 5*b* show a series of idealized windowed blocks that overlap by greater than 50%. In FIG. 5*a,* a transient's initial location is, as shown by the solid-lined arrow, closer to the last window end than it is to the next window end. The pre-noise for the transient's initial location extends back in time to the end of the beginning of the window, as shown. If it is desired to minimize the degree of temporal shift of the transient, it should be shifted "left" to a location closely following the end of the last windowed block, as shown. The resulting pre-noise still extends back to the beginning of the windowed block, but this length is still somewhat shorter than the pre-noise resulting from the initial transient location. In FIG. 5*b,* the initial position of the transient is closer to the next window end than to the previous window end. Thus, if it is desired to minimize the degree of temporal shift of the transient, it should be shifted "right" to a location closely following the end of the next windowed block, as shown. It will be noted that the improvement in pre-noise reduction increases as the initial transient position is later in the interval between successive windowed block ends, as in the case of 50% overlapped blocks.

It will be noted that the improvement in pre-noise reduction is greatest for non-overlapping blocks and decreases as the degree of block overlap increases.

DESCRIPTION OF THE DRAWINGS

FIGS. 1*a*-1*e* are a series of idealized waveforms illustrating examples of transient pre-noise artifacts generated by a fixed block length audio coder system for two cases of input signal conditions.

FIGS. 2*a* and 2*b* show a series of idealized non-overlapping windowed blocks illustrating initial and shifted transient temporal locations, along with the pre-noise for such locations, for the case of an initial position closer to the last window end than to the next window end and for the case of an initial position closer to the next window end than to the previous window end, respectively.

FIG. 7 is a conceptual representation of an input data buffer used for transient detection.

FIGS. 8*a*-8*e* are a series of idealized waveforms illustrating an example of audio time scaling pre-processing in accordance with aspects of the present invention when a transient exists in an audio coding block and is located closer to the last windowed block end than to the next windowed block end.

FIGS. 11*a*-11*f* are a series of idealized waveforms illustrating intelligent time evolution compensation of time scaling using metadata conveyed in the audio stream.

FIG. 12 is a flow chart of time scaling post-processing in conjunction with a low bit rate audio decoder.

FIGS. 13*a*-13*c* are a series of idealized waveforms illustrating an example of post-processing for a single transient to reduce the pre-noise artifacts present after decoding.

FIG. 14 is a flow chart of a post-processing process for improving the perceived quality of audio that has undergone low bit rate coding without time scaling pre-processing.

FIGS. 15*a*-15*c* are a series of idealized waveforms demonstrating the technique of using a default value to time-scale the audio before each transient to reduce pre-noise without performing sample number compensation.

FIGS. 16*a*-16*c* are a series of idealized waveforms demonstrating the technique of using a computed pre-noise duration to time-scale the audio before each transient to reduce pre-noise duration with sample number and time evolution compensation.

BEST MODE FOR CARRYING OUT THE INVENTION

Time Scaling Pre-Processing Overview

Figure 3A:
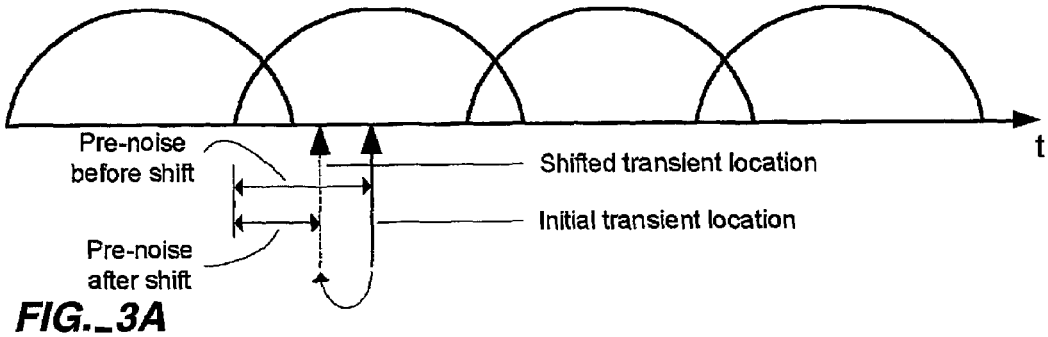
FIGS. 3*a* and 3*b* show a series of idealized less than 50% overlapping windowed blocks illustrating initial and shifted transient temporal locations, along with the pre-noise for such locations, for the case of an initial position closer to the last window end than to the next window end and for the case of an initial position closer to the next window end than to the previous window end, respectively.
Figure 3B:
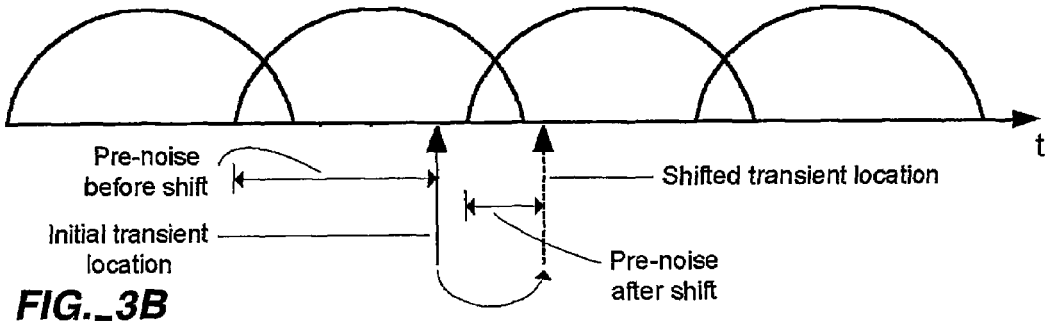
Figure 4A:
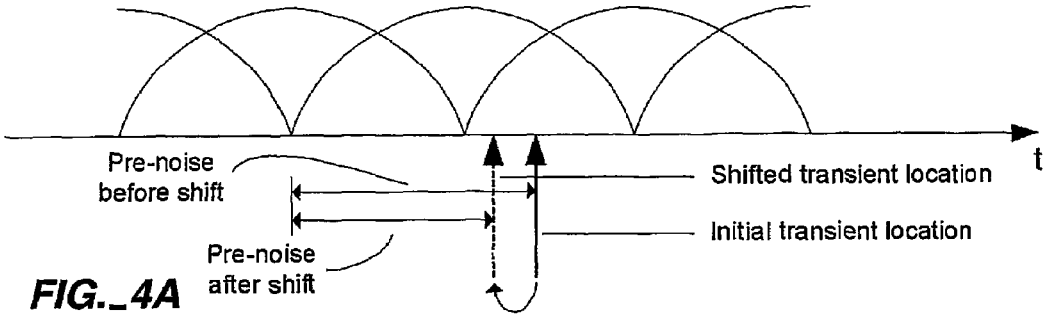
FIGS. 4*a* and 4*b* show a series of idealized 50% overlapping windowed blocks illustrating initial and shifted transient temporal locations, along with the pre-noise for such locations, for the case of an initial position closer to the last window end than to the next window end and for the case of an initial position closer to the next window end than to the previous window end, respectively.
Figure 4B:
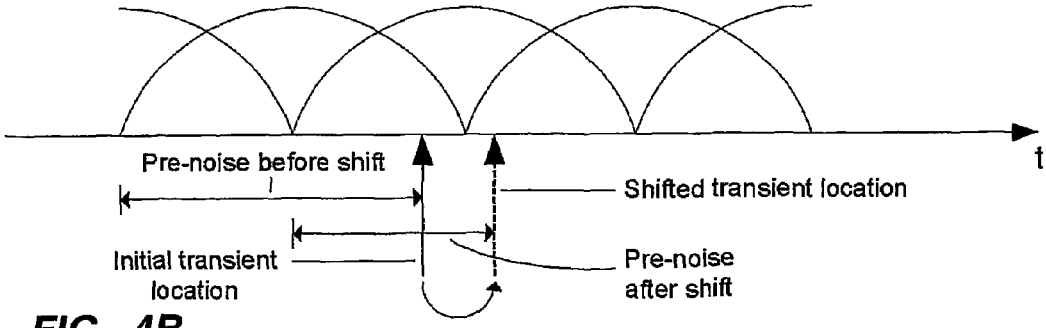
Figure 5A:
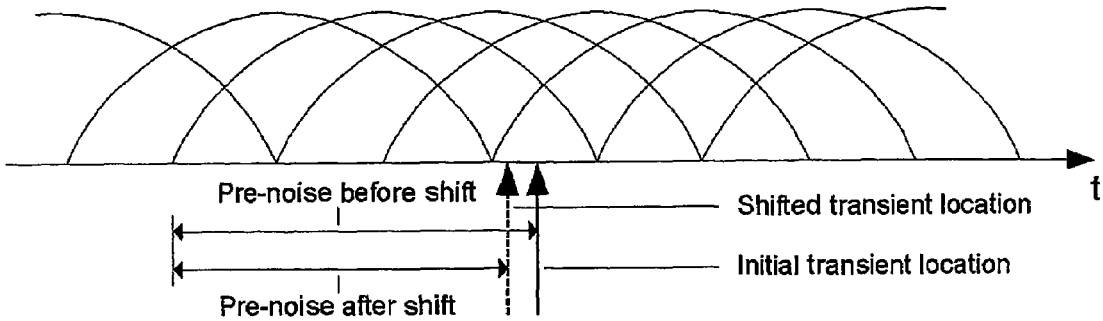
FIGS. 5*a* and 5*b* show a series of idealized greater than 50% overlapping windowed blocks illustrating initial and shifted transient temporal locations, along with the pre-noise for such locations, for the case of an initial position closer to the last window end than to the next window end and for the case of an initial position closer to the next window end than to the previous window end, respectively.
Figure 5B:
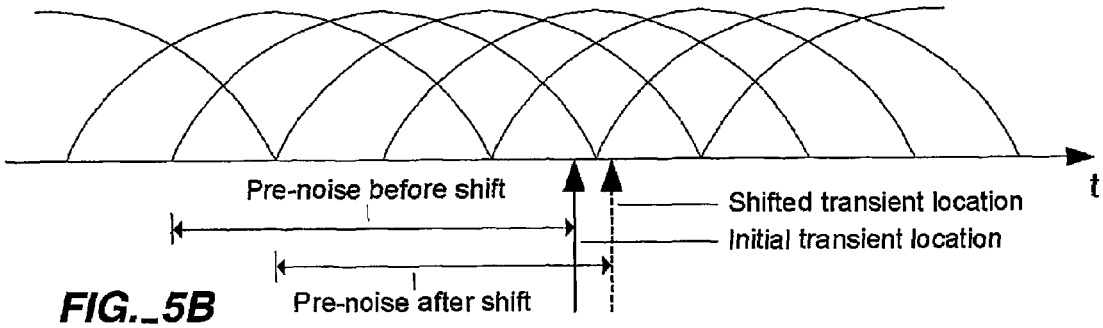
Figure 6:
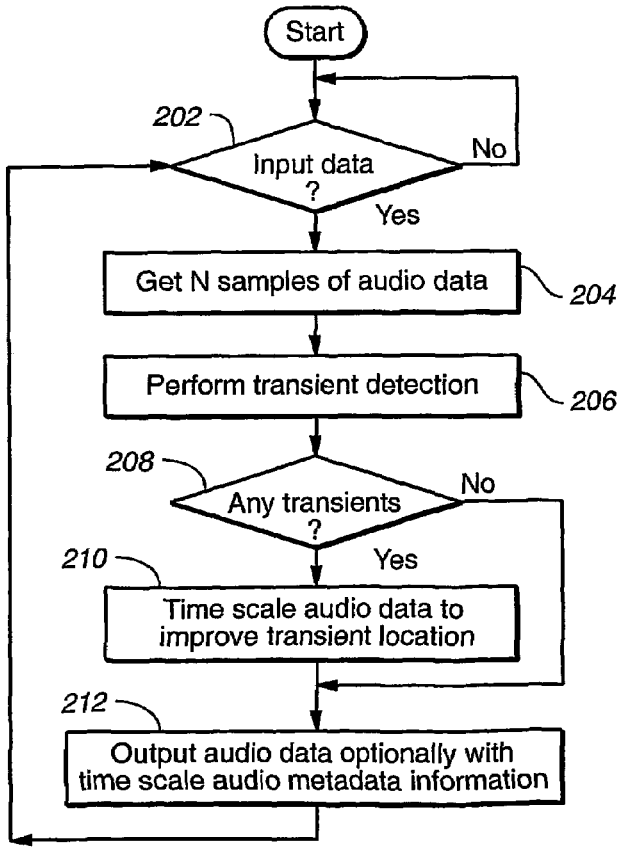
FIG. 6 is a flow chart showing steps to reduce transient pre-noise artifacts by time scaling prior to low bit rate encoding.

FIG. 6 is a flow chart illustrating a method for time-scaling audio prior to low bit rate audio encoding to reduce the amount of transient pre-noise (i.e., "pre-processing"). This method processes the input audio in N sample blocks, where N may correspond to a number greater than or equal to the number of audio samples used in the audio coding block. Processing sizes with N greater than the size of the audio coding block may be desirable to provide additional audio data outside of the audio coding block for use in time scaling processing. This additional data may be used, for example, to sample number compensate for time scaling processing performed to improve the location of a transient.

The first step 202 in the process of FIG. 6 checks for the availability of N audio data samples for time scaling processing. These audio data samples may be from, for example, a file on a PC-based hard disk or a data buffer in a hardware device. The audio data may also be provided by a low bit rate audio coding process that invokes the time scaling processor prior to audio encoding. If N audio data samples are available they are passed (step 204) to and then used by the time scaling pre-processing process in the following steps.

The third step 206 in the pre-processing process is detecting the location of audio data transient signals that are likely to introduce pre-noise artifacts. Many different processes are available to perform this function and the specific implementation is not critical as long as it provides accurate detection of transient signals that are likely to introduce pre-noise artifacts. Many audio coding processes perform audio signal transient detection and this step may be skipped if the audio coding process provides the transient information to the subsequent time scaling processing block 210 along with the input audio data.

Transient Detection

One suitable method for performing audio signal transient detection is as follows. The first step in the transient detection analysis is to filter the input data (treating the data samples as a time function). The input data may, for example, be filtered with a $2^{nd}$ order IIR high-pass filter with a 3 dB cutoff frequency of approximately 8 kHz. The filter characteristics are not critical. This filtered data is then used in the transient analysis. Filtering the input data isolates the high frequency transients and makes them easier to identify. Next, the filtered input data are processed in sixty-four sub-blocks (in the case of a 4096 sample signal sample block) of approximately 1.5 msec (or 64 samples at 44.1 kHz) as shown in FIG. 7. While the actual size of the processing sub-block is not constrained to 1.5 msec and may vary, this size provides a good trade-off between real-time processing requirements (as larger block sizes require less processing overhead) and resolution of transient location (smaller blocks provide more detailed information on the location of transients). The use of 4096 sample signal sample blocks and the use of 64 sample sub-blocks is merely an example and is not critical to the invention.

The next step of transient detection processing is to perform a low-pass filtering of the maximum absolute data values contained in each 64-sample sub-block. This processing is performed to smooth the maximum absolute data and provide a general indication of the average peak values in the input buffer to which the actual sub-buffer peak value can be compared. The method described below is one method of doing the smoothing.

To smooth the data, each 64-sample sub-block is scanned for the maximum absolute data signal value. The maximum absolute data signal value is then used to compute a smoothed, moving average peak value. The filtered, high frequency moving averages for each $k^{th}$ sub-buffer, hi_mavg (k) respectively, are computed using Equations 1 and 2.

```
for buffer k = 1:1:64
  hi__mavg(k) = hi__mavg(k-1) + ((hi freq peak val in buffer k) –
  hi__mavg(k-
1)) * AVG__WHT) (1)
end
```

where hi_mavg(0) is set equal to hi_mavg(64) from the previous input buffer for continuous processing. In the current implementation the parameter AVG_WHT is set equal to 0.25. This value was decided upon following experimental analysis using a wide range of common audio material.

Next, the transient detection processing compares the peak in each sub-block to the array of smoothed, moving average peak values to determine whether a transient exists. While a number of methods exist to compare these two measures the approach outlined below was taken because it allows tuning of the comparison by use of a scaling factor that has been set to perform optimally as determined by analyzing a wide range of audio signals.

The peak value in the $k^{th}$ sub-block, for the filtered data, is multiplied by the high frequency scaling value HI_FREQ_SCALE, and compared to the computed smoothed, moving average peak value of each k. If a sub-block's scaled peak value is greater than the moving average value a transient is flagged as being present. These comparisons are outlined below in Equations 3 and 4.

```
  for buffer k = 1:1:64
if(((hi freq peak value in buffer k) * HI_FREQ_SCALE) > hi_mavg(k))
  (2)
flag high frequency transient in sub-block k = TRUE
  end
    end
```

Following transient detection, several corrective checks are made to determine whether the transient flag for a 64-sample sub-block should be cancelled (reset from TRUE to FALSE). These checks are performed to reduce false transient detections. First, if the high frequency peak values fall below a minimum peak value then the transient is cancelled (to address low level transients). Second, if the peak in a sub-block triggers a transient but is not significantly larger than the previous sub-block, which also would have triggered a transient flag, then the transient in the current sub-block is cancelled. This reduces a smearing of the information on the location of a transient.

Referring again to FIG. 6, the next step 208 in processing is to determine whether transients exist in the current N sample input data array. If no transients exist the input data may be output (or passed back to a low-bit rate audio coder) with no time scaling processing performed. If transients do exist, the number of transients that exist in the current N samples of audio data and their location(s) are passed to the audio time scaling processing portion 210 of the process for temporal modification of the input audio data. The result of suitable time-scale processing is described in connection with the description of FIGS. 8*a*-8*e*. Note that the process requires information from the encoder as to, for example, the location of the windowed sample blocks with respect to the audio data stream. If, optionally, time scaling metadata information is output (as shown in FIG. 6), for the case of no transients it would indicate that no pre-processing was performed. Time scaling metadata may include, for example, time scaling parameters such as the location and amount of time scaling performed and, if cross fading of spliced audio segments is employed by the time scaling technique, the cross fade length. Metadata in the encoded audio bit stream may also include information about transients, including their location after and/or before and after temporal shifting. Audio data is output in step 212.

Audio Pre-Processing

FIGS. 8*a*-8*e* illustrate an example of audio time scaling pre-processing in accordance with aspects of the present invention when a transient exists in an audio coding block and is located closer to the last windowed block end than to the next windowed block end. For this example, a 50% block overlap is assumed, in the manner of FIGS. 1*a*-1*e* and FIGS. 4*a* and 4*b*. As discussed previously, to reduce the amount of transient pre-noise introduced by low bit rate audio coding, it is desired to adjust the time evolution of the input audio signal such that the audio signal transient is located closely following the last windowed block end. Such a shift in the transient location is preferred because it minimizes the disruption to the time evolution of the signal stream while optimally limiting the length of the transient pre-noise. However, as discussed above, a shift to a location closely following the next windowed block end also optimally limits the length of the transient pre-noise but does not minimize disruption to the signal stream's time evolution. In some cases the difference is disruption may be of little or no audible significance, particularly if time evolution compensation is also employed. Thus, a shift to either of the closest block ends is contemplated by the present invention in the present example and in other examples herein. As mentioned above, the transient time shifting time scaling need not be accomplished within a single block unless the processing is performed after the audio signal stream is divided into blocks by the encoder.

FIG. 8*a* shows three consecutive 50% overlapped windowed coding blocks. FIG. 8*b* shows the relationship between the original input audio data stream, containing a single transient and the windowed audio coding blocks. The onset of the transient is T samples after the preceding block end. Because the transient is closer to the preceding block end than the next block end, it is preferred to shift the transient to the left to a location closely following the preceding block end by applying time compression that has the effect of deleting T samples prior to the transient. FIG. 8*c* shows two regions in the audio stream where audio time scaling may be performed. The first region corresponds to the audio samples before the transient where reducing the duration of the audio by T samples "slides" or shifts the position of the transient left to the desired location closely following the end of the preceding block by providing time compression. As in FIGS. 2A through 5B and other figures to be described, the spacing of the transient from the block end in FIGS. 8*d* and 8*e* is exaggerated in the figure for clarity of presentation. The second region shows the region where time scaling optionally may be performed after the transient to increase the duration of the audio by T samples by providing time expansion so that the overall length of the audio data remains at N samples. Although the deletion of T samples and the optional sample number compensating addition of T samples are both shown as occurring within a windowed audio coding sample block, this is not essential—the compensating time-scaling processing need not occur within a single audio coding block unless the transient time shifting is performed after the audio signal stream is divided into blocks by the encoder. The optimum location for such time-scaling processing may be determined by the time-scaling process employed. Because the transient may provide useful post-masking, sample number compensating time scaling preferably is done close to the transient.

FIG. 8*d* demonstrates the resulting signal stream if time scaling processing is performed on the input audio data stream by reducing the time duration of the audio input data stream by T samples in the area before the transient and no sample number compensating time scale expansion is performed after the transient signal. As discussed previously, slight variations in the temporal evolution of an audio signal are not discernable to most listeners. Therefore, if it is not required for the number of time scaled audio data stream samples to equal the number of input samples, N; it may be sufficient only to process the audio stream before the transient. FIG. 8*e* illustrates the case when the audio data stream before the transient is reduced in duration by T samples and the audio data stream following the transient is increased by T samples, thereby maintaining N audio samples in and out of the time scaling processing block and restoring the time evolution of the audio signal stream except for the transient and portions of the signal stream close to the transient. The variations in lengths of the signal waveforms in FIGS. 8*b*-8*e* are intended to show schematically that the number of samples in the audio data stream varies for the described conditions. When the number of audio samples is reduced, as in FIG. 8*d*, additional samples may need to be acquired before additional audio coding can be performed. This may mean reading more samples from a file or waiting for more audio to be buffered in a real-time system.

FIGS. 9*a*-9*e* illustrate an example of audio time scaling processing when a transient exists in a windowed audio coding block and is located approximately T samples before a block end. To reduce the amount of transient pre-noise introduced by low bit rate audio coding while minimizing the transient shift, it is preferred to temporally adjust the input audio signal such that the audio signal transient closely follows the next block end. In the case of 50% overlapped blocks, a shift to the end of the next block end (or the previous block end) limits the transient pre-noise to the first half of an audio coding block, instead of spreading the transient pre-noise throughout that block and the previous audio block.

Figure 9A:
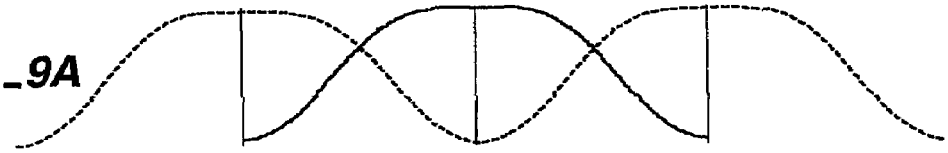
FIGS. 9*a*-9*e* are a series of idealized waveforms illustrating an example of audio time scaling processing when a transient exists in a windowed audio coding block and is located approximately T samples before a block end.
Figure 9B:
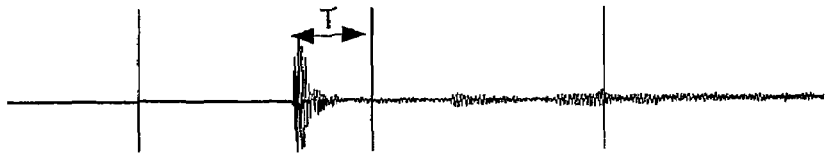
Figure 9C:
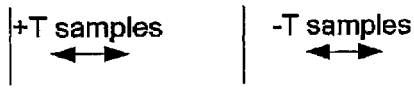
Figure 9D:
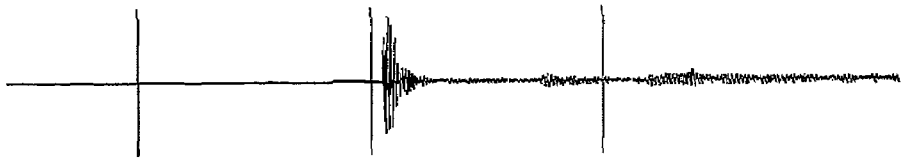

FIG. 9*a* shows three consecutive 50% overlapped windowed coding blocks. FIG. 9*b* shows the relationship between the original input audio data, containing a single transient and the audio blocks. The onset of the transient is T samples before the next block end. Because the transient is closer to the next block end than the previous block end, it is preferred to shift the transient to the right to a location closely following the next block end by applying time expansion that has the effect of adding T samples prior to the transient. FIG. 9*c* shows two regions where audio time scaling may be performed. The first region corresponds to the audio samples before the transient where increasing the duration of the audio by T samples slides the position of the transient to the desired location closely after the next block end. FIG. 9*c* also shows the region where time scaling may be performed after the transient to reduce the duration of the audio by T samples so that the overall length of the audio data stream, N samples, remains constant. FIG. 9*d* demonstrates the result if time scaling processing is performed on the input audio data stream by increasing the time duration of the audio input data stream by T samples in the time region before the transient but without performing sample number compensating time scale expansion after the transient signal. As discussed previously, slight variations in the temporal evolution of an audio signal are not discernable to most listeners. Therefore, if it is not required for the number of audio stream samples after time scaling to equal the input, N. It may be sufficient only to process the audio before the transient.

Figure 9E:
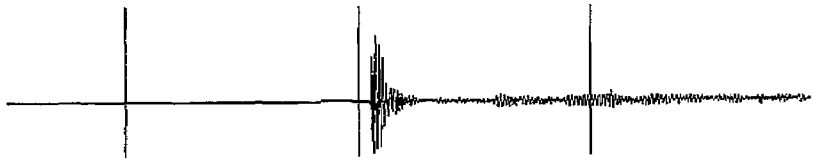

FIG. 9*e* illustrates the case when the audio prior to the transient is increased in duration by T samples and the audio following the transient is reduced by T samples, thereby maintaining a constant number of audio samples before and after time scaling. As in other figures, the spacing of the transient from the block end in FIGS. 9*d* and 9*e* is exaggerated in the figures for clarity of presentation.

Audio Time Scaling Processing for Multiple Transients

Depending upon the length of the audio coding block size and the content of the audio data being coded, it is possible for an input audio data stream being processed to contain, within the N samples being processed, more than one transient signal that may introduce pre-noise artifacts. As mentioned above, the N samples being processed may include more than an audio coding block.

FIGS. 10*a*-10*d* illustrate processing solutions when two transients occur in an audio coding block. In general, two or more transients may be handled in the same manner as a single transient, with the earliest transient in the audio data stream being treated as the transient of interest.

Figure 10A:
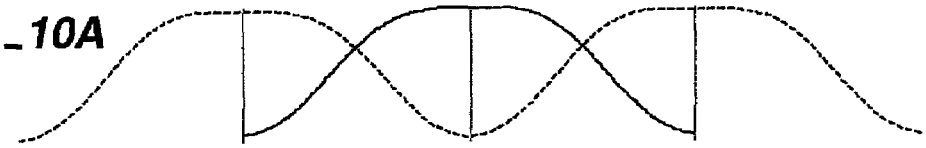
FIGS. 10*a*-10*d* are a series of idealized waveforms illustrating time scaling for the case of multiple transients.
Figure 10B:
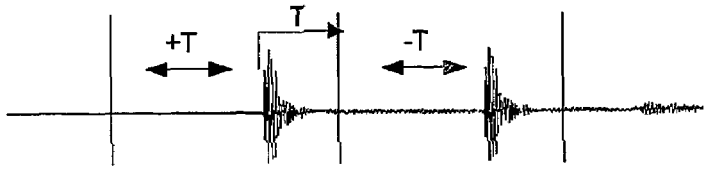

FIG. 10*a* shows three consecutive 50% overlapped windowed coding blocks. FIG. 10*b* shows the case where two transients in the input audio straddle the end of an audio coding block. For this case, the earlier transient introduces the most perceptible pre-noise because a portion of the pre-noise resulting from the second transient is post-masked by the first transient. To minimize the pre-noise artifacts, the input audio signal may be time scaled to shift the first transient to the right such that the audio before the first transient is time scale expanded by T samples, where T is the number of samples which places the first transient to a position closely following the next block end.

In order to sample number compensate for the time scale expansion processing before the first transient in FIG. 10*b* and to optimize post-masking of the pre-noise resulting from the second transient by moving the transients more closely together in time, the audio following the first transient and before the second transient preferably is time scaled to be reduced in duration by T samples. As illustrated in FIG. 10*b*, there is sufficient audio processing data between the first and second transients to perform time scale processing. However, in some cases it may be that the second transient is so close to the first transient that there is not enough audio data to perform time scale processing between them. The amount of audio data required between transients is dependent upon the time scaling process used for the processing. If insufficient audio data exists between the two transients, it may be necessary to time scale expand the audio data following the second transient in order to provide sample number compensation. In order to accomplish expansion of the audio data after the second transient, may be necessary for the time scaling process to have access to a larger segment of audio data than the number of samples in a block used in the audio coding process, as mentioned above.

Figure 10C:
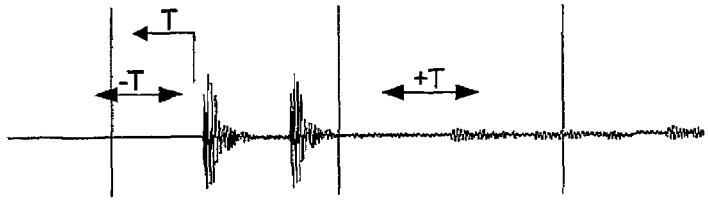

FIG. 10*c* illustrates the case when the first transient is closer to the last block end than the next block end and all of the transients (in this case two) are sufficiently close together that the pre-noise resulting from the first transient is substantially post-masked by the first transient. Thus, the audio stream prior to the first transient preferably is time scale compressed by T samples so that the first transient is shifted to a location just after the prior block end. Sample number compensation to restore the original number of samples, in the form of time scale expansion, may be performed in the audio data stream following the second transient.

Figure 10D:
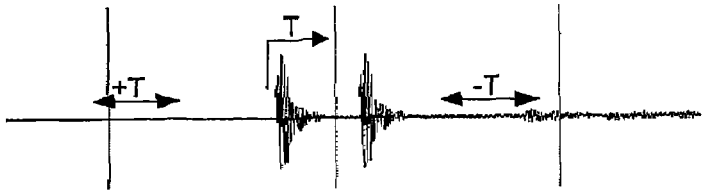

FIG. 10*d* illustrates the case when the first transient is closer to the next block end than the last block end and all of the transients (in this case, two) are sufficiently close together that the pre-noise resulting from the second is substantially post-masked by the first transient. Thus, the audio stream prior to the first transient is time scale expanded by T samples so that the first transient is shifted to a location just after the next block end. Sample number compensation, in the form of time scale compression, optionally may be performed in the audio data stream following the second transient.

For the multiple transient case, if it is desired to time evolution compensate for pre-processing in a near perfect manner, metadata information may be conveyed with each coded audio block in a manner similar to the single transient case described above.

Metadata Controlled Time Evolution Compensation of Time Scaling Pre-Processing

As mentioned above, it may be desirable to apply, subsequent to inverse transformation by the decoder, a compensating time scaling to the audio signal stream after the transient such that the time evolution of the processed audio signal stream is substantially the same as that of the original audio signal stream, thus restoring the original time evolution of the signal stream. However, experimental studies have shown that slight temporal modifications of audio are not perceptible to most listeners and therefore time evolution compensation may not be necessary. Also, on average, transients are advanced and retarded equally and, thus, over a sufficiently long time period, the cumulative effect without time evolution compensation may be negligible. Another issue to be considered is that depending upon the type of time scaling used for pre-processing, the additional time evolution compensating processing may introduce audible artifacts in the audio. Such artifacts may arise because time scaling processing, in many cases, is not a perfectly reversible process. In other words, reducing audio by a fixed amount using a time scaling process and then time expanding the same audio later may introduce audible artifacts.

One benefit of processing audio that contains transient material by time scaling is that time scaling artifacts may be masked by the temporal masking properties of transient signals. An audio transient provides both forward and backward temporal masking. Transient audio material "masks" audible material both before and after the transient such that the audio directly preceding and following is not perceptible to a listener. Pre-masking has been measured and is relatively short and lasts only a few milliseconds while post-masking may last longer than 100 msec. Therefore, time-scaling time evolution compensation processing may be inaudible due to temporal post-masking effects. Thus, if performed, it is advantageous to perform time evolution compensation time-scaling within temporally masked regions.

FIGS. 11*a*-11*f* shows an example where intelligent time evolution compensation is performed following inverse transformation in the decoder using metadata information. The metadata greatly reduces the amount of analysis required to perform time evolution compensation because it indicates where time scaling processing should be performed and the duration of time scaling required. As explained above, time evolution compensating processing is intended to return the decoded audio signal to its original temporal evolution in which the signal stream, including the transient, has its original location in the audio stream. FIG. 11*a* shows three consecutive 50% overlapped windowed coding blocks. FIG. 11*b* shows an input audio stream prior to pre-processing having a transient T samples after a block end. FIG. 11*c* shows that the input audio stream is processed by deleting T samples prior to the transient to shift the transient to an earlier location. T samples are added after the transient in order to leave the number of audio data sample unchanged (sample number compensation). FIG. 11*d* shows the modified audio stream in which the transient is shifted to an earlier location and audio following the transient is shifted back to its original location. FIG. 11*e* shows the required time evolution compensating time scaling regions in which the deletion of T samples (time compression) is compensated by adding T samples (time expansion) and the addition of T samples (time expansion) is compensated by deleting T samples (time compression). The result, shown in FIG. 11*f* is a compensated "near perfect" output signal having the same time evolution as the input signal of FIG. 11*a* (subject mainly to imperfections in the time scaling processes).

Time Scaling Post-Processing to Reduce Transient Pre-Noise

As demonstrated in a number of previous examples, even with optimal placement of a transient in an audio coding block, some pre-noise is still introduced by the low bit rate audio coding system process. As was stated above, longer audio coding blocks are preferred over shorter coding blocks because they provide greater frequency resolution and increased coding gain. However, even if transients are optimally placed by time scaling prior to audio encoding (pre-processing), as the length of the audio coding block increases, the pre-noise also increases. Pre-masking of transient temporal pre-noise is on the order of 5 msec (milliseconds), which corresponds to 240 samples for audio sampled at 48 kHz. This implies that for coders with block sizes greater than approximately 512 samples, transient pre-noise begins to be audible even with optimal placement (only half is masked in the case of 50% overlapped block). (This does not take into account the reduction of transient pre-noise caused by windowing edge effects in the coder's blocks.)

While transient pre-noise may not be removed entirely from a low bit rate coding system, it is possible to perform time scaling post-processing (by itself or in addition to pre-processing) on audio data that has undergone inverse transformation in a transform-based low bit rate audio decoder to reduce the amount of transient pre-noise whether or not pre-processing is also applied. Time scaling post-processing may be performed either in conjunction with a low bit rate audio decoder (i.e., as part of the decoder and/or by receiving metadata from the decoder and/or from the encoder via the decoder) or as a stand-alone post-process. Using metadata is preferred because useful information such as the location of transients in relation to audio coding blocks as well as the audio coding block length(s) are readily available and may be passed to the post-processing process via the metadata. However, post-processing may be used without interaction with a low bit rate audio decoder. Both methods are discussed below.

Time Scaling Post-Processing in Conjunction with a Low Bit Rate Audio Decoder (Receiving Metadata)

FIG. 12 is a flowchart of a process for performing time scaling post-processing in conjunction with a low bit rate audio decoder to reduce transient pre-noise artifacts. The process illustrated in FIG. 12 assumes that the input data is low bit rate encoded audio data (step 802). Following decoding of the compressed data into audio (step 804), the audio corresponding to a block (or blocks) is sent to the time scaler 806 along with metadata information useful in reducing the transient pre-noise duration. This information may include, for example, the location of transients, the length of the audio coder block(s), the relation of the coder block boundaries to the audio data, and a desired length of the transient pre-noise. If the location of the transients in relation to the audio coder's block borders is available, the length and location of the pre-noise artifact may be estimated and accurately reduced by post-processing. Since transients do provide some temporal pre-masking, it may not be necessary to completely remove the transient pre-noise.

By giving the time scaling post-processing process a desired pre-noise length, some control over the amount of pre-noise that is left in the output audio output by step 808 may be achieved. The results of suitable time-scale processing for step 806 is described below in connection with the description of FIGS. 13*a*-13*c*.

Note that post-processing may be useful whether or not pre-processing has been applied prior to encoding. Regardless of where the transient is located with respect to block ends, some transient pre-noise exists. For example, at a minimum it is half the length of the audio coding window for the case of 50% overlap. Large window sizes still may introduce audible artifacts. By performing post processing, it is possible to reduce the length of the pre-noise even more than it was reduced by optimally placing the transient with respect to block ends prior to quantization by the encoder.

FIGS. 13*a*-13*c* illustrate an example of post-processing for a single transient to reduce the pre-noise artifact present after inverse transformation. As shown in FIG. 13*a*, a single transient introduces a pre-noise artifact. Depending on the coding block length, the pre-noise, even after pre-processing, if any, may have a longer time than may be masked by transient temporal pre-masking effects. However, as shown in FIG. 13*b*, by using the transient location metadata information from the decoder, one may identify a region of audio containing the pre-noise in which the pre-noise may be reduced in length by time scaling the audio to reduce the pre-noise by T samples. The number T may be chosen such that the pre-noise length is minimized to take advantage of pre-masking or may be chosen so as to remove the pre-noise completely or nearly completely. If it is desired to maintain the same number of samples as in the original signal, the audio following the transient may be time scale expanded by +T samples. Alternatively, as shown in connection with the example of FIG. 16A, such sample number compensation may be applied prior to the pre-noise, which has the advantage of also providing time evolution compensation.

It should be noted that if post-processing is performed in conjunction with time scaling pre-processing, one may minimize the amount of further disruption to the output audio stream's time evolution. Since the time scaling pre-processing discussed earlier reduces the length of the pre-noise to N/2 samples for the case of 50% block overlap (where N is the length of the audio coding block) one is guaranteed to introduce less than N/2 samples of further time evolution disruption in the output audio as compared to the original input audio. In the absence of pre-processing, the pre-noise can be up to N samples, the coding block length, for the case of 50% block overlap.

In some low bit rate audio coding systems, the location of the signal transients may not be readily available if the encoder does not convey the location information. If that is the case, the decoder or the time scaling process may, using any number of transient detection processes or the efficient method described previously, perform transient detection.

For multiple transients, the same issues apply as for pre-processing, as discussed above.

Time Scaling Post-Processing without Pre-Processing

As mentioned above, in some cases it may be desired to improve the perceived quality of audio that has undergone low bit rate coding using compression systems that do not implement transient pre-noise time scaling processing (pre-processing). FIG. 14 outlines a process for doing that.

The first step 1402 checks for the availability of N audio data samples that have undergone low bit rate audio encoding and decoding. These audio data samples may be from a file on a PC-based hard disk or from a data buffer in a hardware device. If N audio data samples are available, they are passed to the time scaling post-processing process by step 1404.

The third step 1406 in the time-scaling post-processing process is the identification of the location of audio data transient signals that are likely to introduce pre-noise artifacts. Many different processes are available to perform this function and the specific implementation is not important as long as it provides accurate detection of transient signals that are likely to introduce pre-noise artifacts. However, the process described above is an efficient and accurate method that may be used.

The fourth step 1408 is to determine whether transients exist in the current N sample input data array as detected by step 1406. If no transients exist, the input data may be output by step 1414 with no time scaling processing performed. If transients exist the number of transients and their location(s) are passed to the transient pre-noise estimation-processing step 1410 of the process to identify the location and duration of the transient pre-noise.

The fifth and sixth steps 1410 in processing involve estimating the location and duration of the transient pre-noise artifacts and reducing their length with time scaling processing 1412. Since, by definition, the pre-noise artifacts are limited to the regions preceding transients in the audio data, the search area is limited by the information provided by the transient detection processing. As shown in FIG. 1, the length of the pre-noise is limited from a minimum of N/2 to a maximum of N samples where N is the number of audio samples in a 50% overlapped audio coding block. Thus, when N is 1024 samples and audio is sampled at 48 kHz, transient pre-noise may range from 10.7 msec to 21.3 msec before the onset of the transient, depending on the transient location in the audio stream, which significantly exceeds any temporal masking that may be expected from transient signals. Alternatively, instead of estimating the length of the pre-noise artifacts preceding a transient, step 1410 may apply assume that the pre-noise artifacts have a default length.

Two approaches for transient pre-noise reduction may be implemented. The first assumes that all transients contain pre-noise and therefore the audio before every transient may be time scaled (time compressed) by a predetermined (default) amount that is based on an expected amount of pre-noise per transient. If this technique is used, time scale expansion of the audio prior to the temporal pre-noise may be done to provide both sample number compensation for the time compression time scaling processing employed to reduce the length of the pre-noise and to provide time evolution compensation (time expansion prior to the pre-noise that compensates for time compression within the pre-noise leaves the transient in or nearly in its original temporal location). However, if the exact location of the start of the pre-noise is not known, such sample number compensation processing may unintentionally increase the duration of parts of the pre-noise component.

FIGS. 15*a*-15*c* demonstrate a technique that uses a default value to time-scale the audio before each transient to reduce pre-noise duration but does not perform sample number compensation. As shown in FIG. 15*a*, an audio signal stream from a low bit rate audio decoder has a transient preceded by pre-noise. FIG. 15*b* shows a default processing length used as the amount of time compression to be performed by the time scaling processing. FIG. 15*c* shows the resulting audio signal stream having reduced pre-noise. In this example, time evolution compensation is not performed to return the transient to its original location in the audio data stream. However, in a manner similar to previous processing examples, if a constant number of input to output samples are desired, time scale expansion processing following the transient may be performed, similar to the example of FIG. 13*b* or, possibly, before the pre-noise as described below in connection with the example of FIGS. 16*a*-16*c*. However, when applying a default processing length, providing such compensation prior to the pre-noise runs the risk of performing the time scale expansion processing within the pre-noise (thus, undesirably increasing the pre-noise length) if the actual length of the pre-noise exceeds the default length. Moreover, in some cases, the post-processing may not have access to the audio stream prior to the pre-noise—the audio may already be output in order to reduce latency.

A second post-processing pre-noise reduction technique, illustrated in FIGS. 16*a*-16*c*, involves performing analysis of the pre-noise resulting from a transient to determine its length and processing the audio so that only the pre-noise segment is processed. As noted above, transient pre-noise is produced when the high frequency components of transient audio material are temporally smeared throughout a block as a result of the quantizing process in the encoder. Therefore one straight-forward method of detection is to high pass filter the audio prior to a transient and measure the high frequency energy. The start of the transient pre-noise is identified when the noise-like, high frequency pre-noise related to and caused by the transient exceeds a predetermined threshold. When the size and location of the transient pre-noise is known, compensating time scale expansion of the audio may be performed prior to time scale reduction of the pre-noise to return the audio to its original temporal evolution and to restore the time evolution of the audio stream substantially to its original condition. The invention is not limited to employing high frequency detection. Other techniques for detecting or estimating the length of the pre-noise may be employed.

In FIG. 16*a*, an audio signal stream from a low bit rate audio decoder has a transient preceded by pre-noise. FIG. 16*b* shows a time compression processing length used as the amount of time scale reduction to be performed by the time scaling processing based on an estimated pre-noise length as measured by the high frequency audio content in the block. FIG. 16*b* also shows the use of time expansion by T samples in order to restore the original time evolution of the signal stream and also to restore the original number of samples. FIG. 16*c* shows the resulting audio signal stream having reduced pre-noise along with the original time evolution and the same number of samples as the original signal stream.

The present invention and its various aspects may be implemented as software functions performed in digital signal processors, programmed general-purpose digital computers, and/or special purpose digital computers. Interfaces between analog and digital signal streams may be performed in appropriate hardware and/or as functions in software and/or firmware.

The invention claimed is:

1. A method for reducing distortion artifacts preceding a signal transient in an audio signal stream processed by a transform-based low-bit-rate audio coding system employing coding blocks, comprising detecting a transient in the audio signal stream prior to processing by said coding system, shifting the temporal relationship of said transient with respect to said coding blocks by time scaling a segment of said audio signal stream preceding said signal transient such that the time duration of said distortion artifacts is reduced, and applying a compensating time scaling to the audio signal stream subsequent to inverse transformation in the decoder of said coding system such that the time evolution of the processed audio signal stream is substantially the same as that of the audio signal stream prior to said shifting.

2. The method of claim 1 wherein said compensating time scaling is applied to a segment of said audio signal stream preceding said signal transient.

3. The method of claim 1 wherein said coding system includes an encoder and a decoder, said encoder transmitting metadata to said decoder along with an encoded version of said audio signal stream, said metadata including information useful for applying said compensating time scaling.

4. The method of claim 1 wherein said time scaling is performed on a segment of said audio stream closely preceding said transient.

5. The method of claim 1 wherein said shifting shifts the temporal relationship of said transient with respect to said coding blocks prior to forward transforming in the encoder of said coding system.

6. The method of claim 5 wherein said transient is shifted to a temporal position closely following the next block end or closely following the last block end.

7. The method of claim 6 wherein said transient is shifted to a temporal position closely following the next block end or closely following the last block end which results in the shorter shift of temporal position.

8. A method according to any one of claims 1-7 further comprising removing at least a portion of remaining distortion artifacts after inverse transformation in the decoder of said coding system.

9. The method of claim 8 wherein the portion of remaining distortion artifacts is determined at least in part by metadata information carried in said coding system.

10. The method of claim 8 wherein the portion of remaining distortion artifacts is determined at least in part by a default parameter.

11. The method of claim 8 wherein the portion of remaining distortion artifacts is determined at least in part by a measure of high frequency audio components in said audio signal stream.

12. The method of claim 6 wherein said metadata information includes one or more of the location of transients, the length of the audio coder block(s), the relation of the coder block boundaries to the audio data, and a desired length of the transient pre-noise.

13. The method of claim 4 wherein said time scaling is performed on a segment of said audio stream that is at least partially temporally pre-masked by transient.

14. In a decoder of a transform-based low-bit-rate audio coding system employing coding blocks, a method for reducing distortion artifacts preceding a signal transient in an audio signal stream subsequent to inverse transformation, comprising detecting a transient in the audio signal stream, time compressing at least a portion of said distortion artifacts such that the time duration of said distortion artifacts is reduced, and time expanding prior to said time compression such that the time evolution and length of the audio signal stream is substantially unchanged.

15. In a decoder of a transform-based low-bit-rate audio coding system employing coding blocks, a method for reducing distortion artifacts preceding a signal transient in an audio signal stream subsequent to inverse transformation, comprising receiving metadata information useful in reducing the transient pre-noise duration, time compressing at least a portion of said distortion artifacts such that the time duration of said distortion artifacts is reduced, and time expanding prior to said time compression such that the time evolution and length of the audio signal stream is substantially unchanged.

16. A method for reducing distortion artifacts preceding a signal transient in an audio signal stream processed by a transform-based low-bit-rate audio coding system employing coding blocks, comprising detecting a transient in the audio signal stream prior to processing by said coding system, shifting the temporal relationship of said transient with respect to said coding blocks by time scaling a segment of said audio signal stream preceding said signal transient such that the time duration of said distortion artifacts is reduced, wherein said time scaling has the effect of deleting signal components from or adding signal components to the audio signal stream applied to the coding system, and applying a further time scaling following said signal transient, said further time scaling acting in the opposite sense to the said first-recited time scaling.

17. A method for reducing distortion artifacts preceding a signal transient in an audio signal stream processed by a transform-based low-bit-rate audio coding system employing coding blocks, comprising detecting a transient in the audio signal stream prior to processing by said coding system, shifting the temporal relationship of said transient with respect to said coding blocks by time scaling a segment of said audio signal stream preceding said signal transient such that the time duration of said distortion artifacts is reduced, wherein said time scaling has the effect of deleting signal components from or adding signal components to the audio signal stream applied to the coding system, and applying compensating time scaling to the audio signal stream preceding said distortion artifacts, which precede said transient, and subsequent to inverse transformation in the decoder of said coding system such that the time evolution of the processed audio signal stream is substantially the same as that of the audio signal stream prior to said shifting and the time duration of said audio signal stream is substantially unchanged.

18. A method for reducing distortion artifacts preceding a signal transient in an audio signal stream processed by a transform-based low-bit-rate audio coding system employing coding blocks, comprising detecting a transient in the audio signal stream prior to processing by said coding system, shifting the temporal relationship of said transient with respect to said coding blocks by time scaling a segment of said audio signal stream preceding said signal transient such that the time duration of said distortion artifacts is reduced, and applying a further time scaling following said signal transient, said further time scaling acting in the opposite sense to the said first-recited time scaling.

19. A method for reducing distortion artifacts preceding a signal transient in an audio signal stream processed by a transform-based low-bit-rate audio coding system employing coding blocks, comprising detecting multiple transients in the audio signal stream prior to processing by said coding system, shifting the temporal relationship of the first of said transients with respect to said coding blocks by time scaling a segment of said audio signal stream preceding the first of said signal transients such that the time duration of the distortion artifacts prior to the first of said transients is reduced, and applying a further time scaling following the first of said transients and before one or more other of said multiple transients, said further time scaling acting in the opposite sense to the said first-recited time scaling.

20. In a decoder of a transform-based low-bit-rate audio coding system employing coding blocks, a method for reducing distortion artifacts preceding a signal transient in an audio signal stream subsequent to inverse transformation, comprising detecting a transient in the audio signal stream, time compressing at least a portion of said distortion artifacts such that the time duration of said distortion artifacts is reduced, and time expanding subsequent to said time compression such that the length of the audio signal stream is substantially unchanged.

21. In a decoder of a transform-based low-bit-rate audio coding system employing coding blocks, a method for reducing distortion artifacts preceding a signal transient in an audio signal stream subsequent to inverse transformation, comprising receiving metadata information useful in reducing the transient pre-noise duration, time compressing at least a portion of said distortion artifacts such that the time duration of said distortion artifacts is reduced, and time expanding subsequent to said time compression such that the length of the audio signal stream is substantially unchanged.

22. The method of claim 16 wherein said further time scaling is applied prior to forward transforming in the encoder of said coding system.

23. The method of claim 16 wherein said further time scaling is applied subsequent to inverse transformation in the decoder of said coding system.

24. The method of claim 16 wherein the time duration of the signal components added or deleted by said further time scaling is substantially the same as the time duration of signal components deleted or added by said first-recited time scaling, respectively, whereby the time duration of said audio signal stream is substantially unchanged.

25. The method of claim 17 wherein said coding system includes an encoder and a decoder, said encoder transmitting metadata to said decoder, said metadata including information useful for applying said compensating time scalings.

26. The method of any one of claims 1, 14, 15 and 16-21 wherein said audio signal stream applied to the coding system is a digital signal stream in which the audio information is represented by samples, the order of said samples representing time, and wherein said time scaling has the effect of deleting samples from or adding samples to the digital signal stream applied to the coding system.

27. The method of claim 18 wherein said further time scaling is performed on a segment of said audio stream closely following said transient.

28. The method of claim 27 wherein said time scaling is performed on a segment of said audio stream that is at least partially temporally post-masked by transient.

29. The method of claim 18 wherein said first-recited time scaling has the effect of deleting signal components from or adding signal components to the audio signal stream applied to the coding system and said further time scaling has the effect of adding signal components to the audio signal stream when said first-recited time scaling deletes signal components and said further time scaling has the effect of deleting signal components to the audio signal stream when said first-recited time scaling adds signal components.

30. The method of claim 29 wherein the time duration of the signal components added or deleted by said further time scaling is substantially the same as the time duration of signal components deleted or added by said first-recited time scaling, respectively, whereby the time duration of said audio signal stream is substantially unchanged.

31. The method of claim 18 wherein said audio signal stream applied to the coding system is a digital signal stream in which the audio information is represented by samples, the order of said samples representing time, and wherein said first-recited time scaling has the effect of deleting samples from or adding samples to the digital signal stream applied to the coding system and said further time scaling has the effect of adding samples to the digital signal stream when said first-recited time sampling deletes samples from the digital signal stream and said further time scaling has the effect of deleting samples from the digital signal stream when said first-recited time sampling adds samples to the digital signal stream.

32. The method of claim 19 wherein a further time scaling is applied following the first of said transients and after one or more other of said multiple transients, said further time scaling acting in the opposite sense to the said first-recited time scaling.

33. The method of claim 14 or claim 20 wherein the portion of the distortion artifacts is determined at least in part by the location of the detected transient and a default parameter.

34. The method of claim 14 or claim 20 the portion of the distortion artifacts is determined at least in part by the location of the detected transient and signal characteristics preceding said transient.

35. The method of claim 34 wherein said signal characteristics include a measure of high-frequency components of the audio signal stream.

36. The method of claim 14 or claim 20 further comprising receiving metadata information useful in reducing the transient pre-noise duration.

37. The method of claim 14 or claim 20 wherein said metadata information includes one or more of the length of the audio coder block(s), the relation of the coder block boundaries to the audio data, and a desired length of the transient pre-noise.

38. The method of claim 15 or claim 21 wherein said metadata information includes one or more of the location of transients, the length of the audio coder block(s), the relation of the coder block boundaries to the audio data, and a desired length of the transient pre-noise.

* * * * *